US005260533A

United States Patent [19]

Livesey et al.

[11] Patent Number: 5,260,533

[45] Date of Patent: Nov. 9, 1993

[54] MOLDED CASE CURRENT LIMITING CIRCUIT BREAKER

[75] Inventors: John K. Livesey, Monaca; Richard E. White, Brighton Twp.; Alfred E. Maier, Beaver Falls; Amelia M. Stay, Beaver; Douglas C. Marks, Murrysville; Walter O. Jenkins, Pittsburgh, all of Pa.

[73] Assignee: Westinghouse Electric Corp., Pittsburgh, Pa.

[21] Appl. No.: 779,482

[22] Filed: Oct. 18, 1991

[51] Int. Cl.[5] ..... H01H 5/23

[52] U.S. Cl. ..... 200/401; 200/288; 200/337; 335/172

[58] Field of Search ..... 200/400, 401, 337, 288; 335/167, 172, 173, 174

[56] References Cited

U.S. PATENT DOCUMENTS

| | | | |
|---|---|---|---|
| 2,830,158 | 7/1955 | Coleman | 200/144 R |
| 3,158,698 | 11/1964 | Campbell | 200/16 C |
| 3,569,947 | 3/1971 | Radus | 365/57 |
| 3,731,239 | 5/1973 | Ellenberger | 335/167 |
| 3,774,129 | 11/1973 | Sugiyama | 335/167 |
| 3,783,423 | 1/1974 | Mater et al. | 335/174 |
| 3,798,580 | 3/1974 | Cellerini | 335/37 |
| 4,181,836 | 1/1980 | Miracle | 200/144 R |
| 4,291,291 | 9/1981 | Merchant | 335/191 |
| 4,405,846 | 9/1983 | Belttary | 200/144 R |
| 4,431,877 | 2/1984 | Heft et al. | 200/144 R |
| 4,580,021 | 4/1986 | Fujikake | 200/400 |
| 4,581,511 | 4/1986 | Leone | 200/306 |
| 4,616,112 | 10/1986 | Galloway et al. | 200/5 R |
| 4,622,530 | 11/1986 | Ciarcia et al. | 340/506 |
| 4,642,431 | 2/1987 | Tedesco et al. | 200/401 |
| 4,679,016 | 7/1987 | Ciarcia et al. | 335/132 |
| 4,716,265 | 12/1987 | Fujii et al. | 200/144 R |
| 4,733,211 | 3/1988 | Castonguay et al. | 335/192 |
| 4,736,174 | 4/1988 | Castonguay et al. | 335/167 |
| 4,855,549 | 8/1989 | Toda et al. | 200/288 X |
| 4,891,618 | 1/1990 | Paton | 335/195 |
| 4,928,079 | 5/1990 | Male et al. | 335/13 |
| 5,070,361 | 12/1991 | Magnon et al. | 335/172 |

*Primary Examiner*—Henry J. Recla
*Assistant Examiner*—Glenn T. Barrett
*Attorney, Agent, or Firm*—M. J. Moran

[57] ABSTRACT

A molded case circuit breaker having current limiting capabilities is dimensionally optimized for relatively smaller frame size circuit breakers. The handle yoke is supported with rollers thereby allowing the crossbar to be disposed in the space normally utilized for the handle yoke pivot axis. A clinch joint arcer assembly with a plurality of arcing contact arms, each pivotally connected by a clinch joint to a pivotally mounted main contact arm permits additional main contact arms to be provided in the same space normally occupied by the arcing contact arms alone. Additionally, arcing contact spring housings protect the arcing contact springs from deterioration due to corrosive ionizing gases generated during interruption. A positive off link assembly prevents the operating handle from being placed on an OFF position when the main contacts are welded together and transfers the force applied to the operating handle to the upper link to allow the weld to be broken. Lastly, a reversible barrier in one of the sidewalls allows in one position circuit breaker auxiliaries, located in the outside pole compartments, to communicate with the operating mechanism and the operating handle. For circuit breakers without auxiliaries, the barrier acts as an interphase gas barrier.

17 Claims, 15 Drawing Sheets

FIG.6
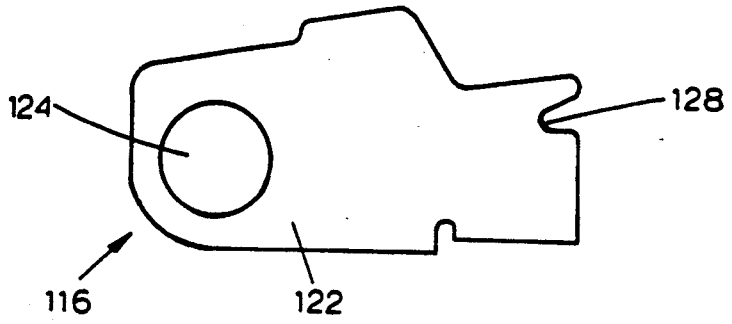
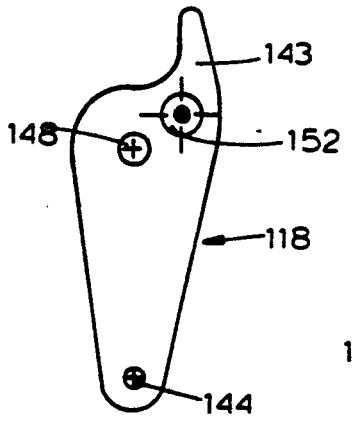
FIG.7
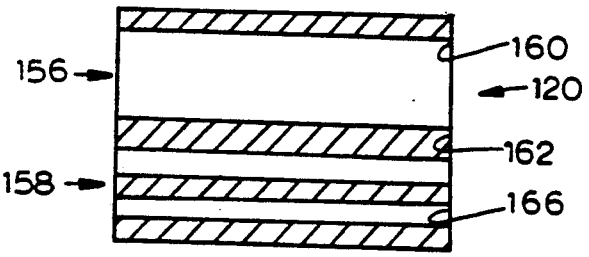
FIG.8
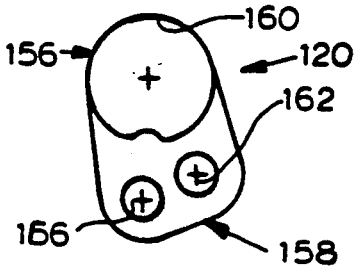
FIG.9
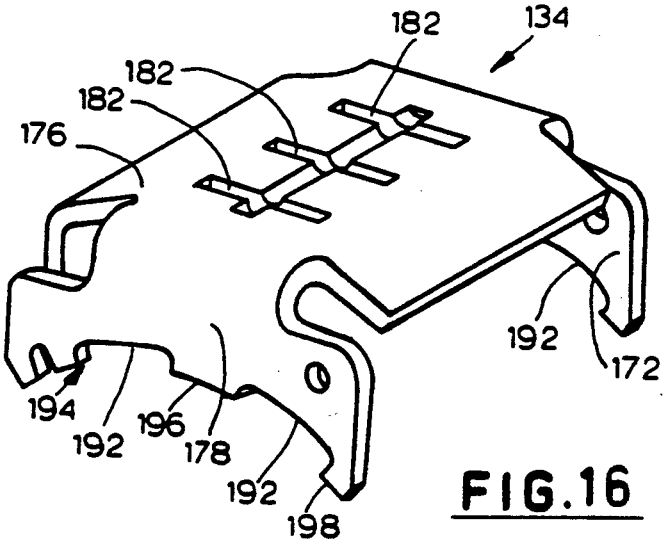
FIG.16

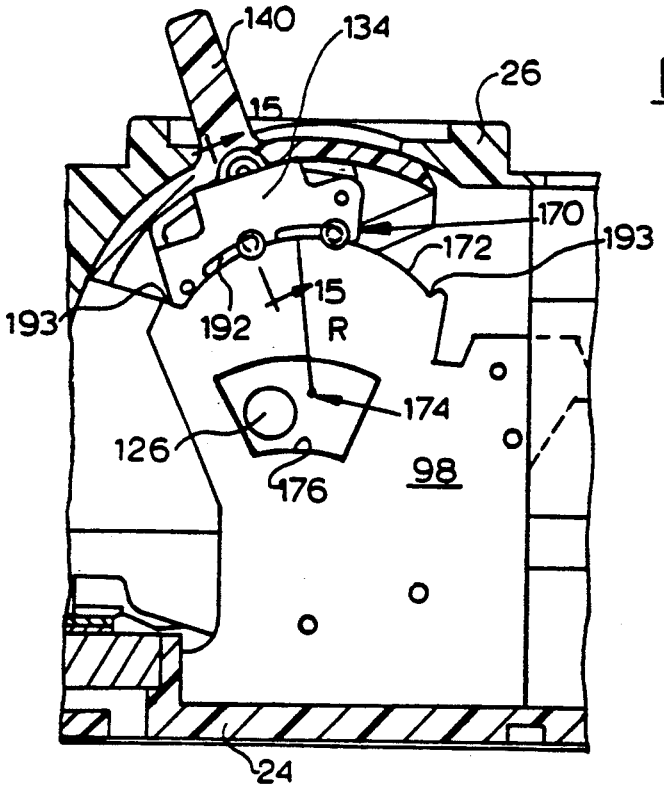
FIG.12
FIG.13
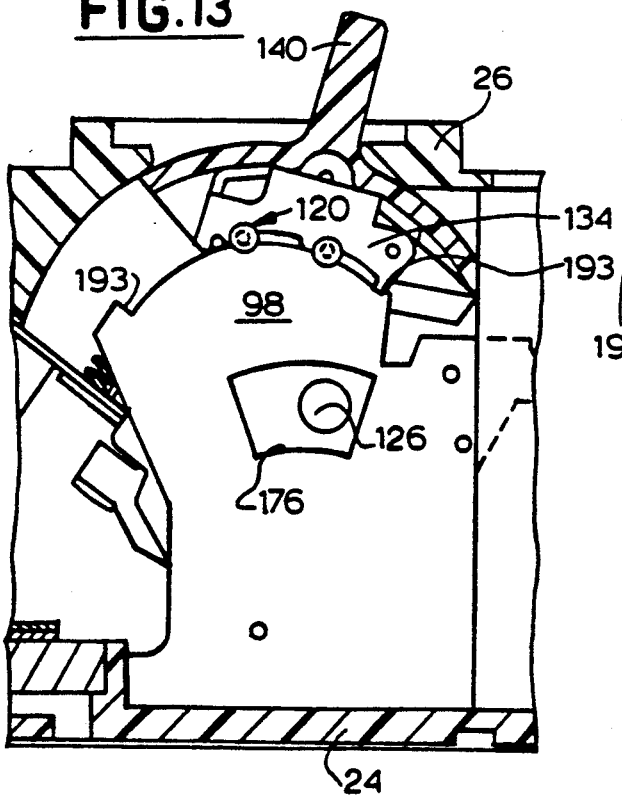
FIG.14
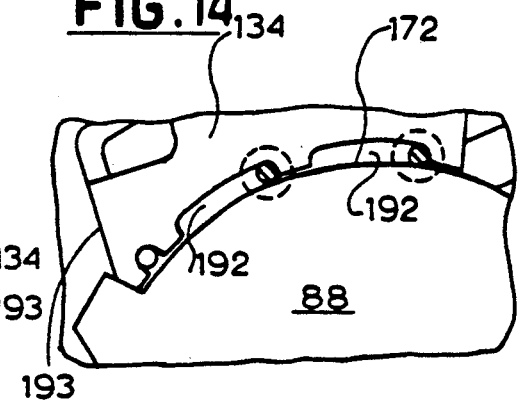
FIG.15
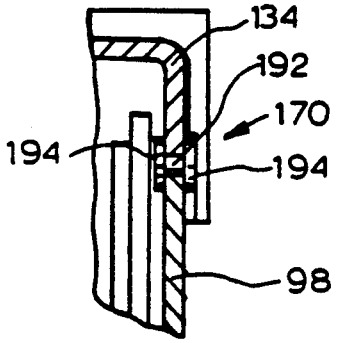

MOLDED CASE CURRENT LIMITING CIRCUIT BREAKER

CROSS REFERENCE TO RELATED APPLICATIONS

This application is related to another patent application Ser. No. 07/779,441, now abandoned, filed on even date, entitled MOLDED CASE CURRENT LIMITING CIRCUIT BREAKER, by Ronald W. Crookston, Douglas C. Marks, Richard E. White, Andrew J. Male, Steven Castelein, Yunko N. Chien, John G. Salvati, William Beatty and Alred E. Maier.

One aspect of the present invention relates to positive off mechanisms for molded case circuit breakers. The following patent applications relate to positive off mechanisms for molded case circuit breakers: Ser. No. 07/503,812, filed on Apr. 3, 1990, U.S. Pat. No. 5,142,112, entitled CIRCUIT BREAKER POSITIVE OFF LINK, by David A. Parks, Thomas A. Whitaker and Y. W. Chan, Ser. No. 07/511,700, filed on Apr. 20, 1990, now abandoned, entitled CIRCUIT BREAKER WITH POSITIVE INDICATION OF WELDED CONTACTS, by R. J. Tedesco and P. L. Ulerich.

The following patent applications all relate to molded case circuit breakers: Ser. No. 07/226,503, filed Aug. 1, 1988, U.S. Pat. No. 5,057,806, entitled CROSSBAR ASSEMBLY, by Jere L. McKee, Lance Gula and Glenn R. Thomas.

The following commonly assigned U.S. patent applications were filed on Oct. 12, 1988 and all relate to moulded case circuit breakers: Ser. No. 07/256,881, now abandoned, entitled SCREW ADJUSTABLE CLINCH JOINT WITH BOSSES, by James N. Altenhof, Ronald W. Crookston, Walter V. Bratkowski, and J. Warren Barkell, and Ser. No. 07/256,878, now abanded, entitled TWO-PIECE CRADLE LATCH FOR CIRCUIT BREAKER, by Alfred E. Maier and William G. Eberts.

The following commonly owned patent applications also relate to circuit breakers: Ser. No. 07/491,329, filed on Mar. 9, 1990, U.S. Pat. No. 5,032,813, entitled PINNED SHUNT END EXPANSION JOINT, by Lance Gula and Roger W. Helms, Ser. No. 07/543,985, filed on Jun. 26, 1990, U.S. Pat. No. 5,193,093, entitled PHASE SENSITIVITY, by Stephen Mrenna, L. M. Hapeman, John A. Wafer, Robert J. Tedesco, Kurt A. Grunert and Henry A. Wehrli III, Ser. No. 07/574,978, filed on Aug. 30, 1990, U.S. Pat. No. 5,119,054, entitled E FRAME PANCAKE DESIGN,, by Kurt A. Grunert, John A. Wafer, H. A. Wehrli III and L. M. Hapeman, Ser. No. 07/676,584, filed on Mar. 28, 1991, U.S. Pat. No. 5,206,614, entitled LINE COPPER GASKET, by Arthur Carothers, and Ser. No. 07/709,008, filed on Mar. 28, 1991 U.S. Pat. No. 5,196,658, entitled INTEGRAL MANUAL ON/OFF CRANK ASSEMBLY, by Lance Gula.

BACKGROUND OF THE INVENTION

1. Technical Field

The present invention relates to a molded case circuit breaker and more particularly to a current limiting molded case circuit breaker, dimensionally optimized to enable the current limiting circuit breaker to be disposed in a relative small breaker frame size.

2. Description

Molded case circuit breakers are generally known in the art. An example of such a circuit breaker is disclosed in U.S. Pat. No. 4,891,618. Such circuit breakers are used to protect electrical circuitry from damage due to an overcurrent condition, such as an overload or a short circuit or both. An overload normally is about 200–300% of the nominal current rating of the circuit breaker, while a short circuit may be 1000% or more of the nominal current rating of the circuit breaker.

Overload protection is normally provided by a bimetal disposed in series with a load conductor. The bimetal normally consists of two strips of metal having different rates of thermal expansion, bonded together at one end. On a sustained overload, the bimetal will deflect due to the heat and engage the circuit breaker trip bar to trip the circuit breaker.

Short circuit protection may be provided by an electromagnet assembly or by magnetic repulsion forces. Electromagnet assemblies include an electromagnetic disposed in series with a load conductor and include a cooperating armature which latches the circuit breaker trip bar during normal conditions. During a short circuit condition, the short circuit current passes through the electromagnet which generates attraction forces to attract the armature and unlatch the trip bar which, in turn, causes the circuit breaker to trip.

Short circuit protection may also be provided by magnetic repulsion members. For example, as disclosed in U.S. Pat. No. 4,891,618, magnetic repulsion members, which consist of flexible shunts are formed in generally a V-shape defining two depending legs. The flexible shunts are used to connect the pivotally mounted contact arms to the load conductors. During a short circuit condition, the short circuit current flowing in the depending legs of the shunts generate repulsion forces between the depending legs which causes the pivotally mounted contact arms to blow open.

The electromagnetic assemblies are normally used to provide short circuit protection where the expected short circuit current is 50,000 amperes or less. Since modern electrical distributing systems are capable of delivering substantially larger short circuit current, for example, 100,000 amperes or more, current limiting molded case circuit breakers are used in such applications. Such current limiting circuit breakers have been known to use magnetic repulsion members to interrupt short circuit currents of 100,000 amperes or more.

Such current limiting circuit breakers are provided in various frame sizes. The frame size refers to a number of important characteristics of the circuit breaker, such as maximum allowable voltage and current, interrupting capacity and physical dimensions of the molded case. For example, U.S. Pat. No. 4,891,618 relates to Westinghouse Series C, Reframe circuit breaker, rated at 600 volts and 1600/2000 amperes.

Since molded case circuit breakers and in particular current limiting molded case circuit breakers are relatively compact, a problem exists to provide current limiting capabilities for a circuit breaker in relatively smaller frame sizes. More specifically, the components in a relatively larger frame size current limiting molded case circuit breaker cannot merely be downsized to provide a current limiting circuit breaker in a smaller frame size.

SUMMARY OF THE INVENTION

It is an object of the present invention to solve the problems associated with the prior art.

It is another object of the present invention to provide current limiting capabilities in circuit breakers with relatively smaller frame sizes.

Briefly, the present invention relates to a molded case circuit breaker having current limiting capabilities, dimensionally optimized for relatively smaller frame sizes. More specifically, one aspect of the invention relates to supporting the handle yoke with rollers. By supporting the handle yoke with rollers, space is conserved within the circuit breaker housing by allowing the crossbar to be disposed in the space normally utilized for the handle yoke pivot axis. Another important aspect of the invention which conserves space within the circuit breaker is a clinch joint arcer assembly. This assembly includes a plurality of arcing contact arms, each pivotally connected by way of a clinch joint to a pivotally mounted main contact arm. By pivotally mounting the arcing contact arms to the main contact arms, additional main contact arms can be provided in the same space normally occupied by the arcing contact arms alone. Additionally, arcing contact spring housings are provided. These spring housings protect the arcing contact springs from deterioration due to corrosive ionizing gases generated during interruption. With the restraints of the physical dimensions of a relatively smaller breaker frame size, additional features have also been incorporated. For example, a positive off link assembly prevents the operating handle from being placed in an OFF position during a condition when the main and/or arcer contacts are welded together. The positive off link assembly further transfers the force applied to the operating handle to be applied to the upper toggle link to allow the weld to be broken. If the weld cannot be broken, the assembly returns the operating handle to the ON position. Lastly, a reversible barrier is provided in one of the sidewalls which in one position allows circuit breaker auxiliaries, located in the outside pole phase compartments, to communicate with the operating mechanism and the operating handle. For circuit breakers provided without auxiliaries, the barrier acts as an interphase gas barrier.

DESCRIPTION OF THE DRAWING

These and other objects and advantages of the present invention will become readily apparent upon consideration of the following detailed description and attached drawing, wherein:

FIG. 6 is an elevational view of an upper toggle link in accordance with the present invention;

FIG. 7 is an elevational view of a trip link in accordance with the present invention;

FIG. 8 is a sectional view along line 8—8 of FIG. 5 illustrating an insulator link in accordance with the present invention;

FIG. 9 is an end view along 9—9 of FIG. 5 of the insulator link illustrated in FIG. 8;

FIG. 12 is a simplified partial sectional view similar to FIG. 2 illustrating the handle yoke rollers in accordance with the present invention with the circuit breaker shown in an ON position;

FIG. 13 is similar to FIG. 12 illustrating the circuit breaker in an OFF position;

FIG. 14 is similar to FIG. 12 illustrating the relationship between the roller pins and the handle yoke when the circuit breaker is in an ON position;

FIG. 15 is a partial sectional view along line 15—15 of FIG. 2;

FIG. 16 is a perspective view of a handle yoke in accordance with the present invention;

DETAILED DESCRIPTION

As illustrated and described herein, a Westinghouse Series C, N-frame, molded case circuit breaker is described and illustrated. However, it will be appreciated by those of ordinary skill in the art that the principles of the present invention are applicable to various types of molded case circuit breakers. Moreover, for simplicity, only the center pole of a multiple pole molded case circuit breaker is described in detail and illustrated.

As is known by those of ordinary skill in the art, circuit breakers are provided in various sizes and assigned a frame size. The frame size refers to various characteristics of the circuit breaker, such as the allowable voltage and current ratings as well as the interrupting capacity and the physical dimensions of the circuit breaker. Generally speaking, the physical dimensions of the circuit breaker housing are related to the ratings of the circuit breaker. More specifically, relatively larger circuit breaker housings are used for circuit breakers with relatively higher ratings.

The principles of the present invention are directed toward an intermediate breaker frame size, such as a 1200 ampere frame, for a circuit breaker having current limiting capabilities. Such current limiting capabilities generally allow the circuit breaker to interrupt relatively large magnitudes of overcurrent, such as short circuit current, which may be 100,000 amperes or more. Such relatively large magnitudes of current are generally interrupted by way of magnetic repulsion forces, generated within the circuit breaker. Known mechanisms, such as disclosed in U.S. Pat. No. 4,891,618, assigned to the same assignee as the assignee of the present invention, are generally not suitable for circuit breakers of relatively smaller frame sizes due to the amount of physical space required. Accordingly, one aspect of the molded case circuit breaker in accordance with the present invention, enables current limiting capabilities to be incorporated into a relatively smaller frame size housing.

Figure 1:
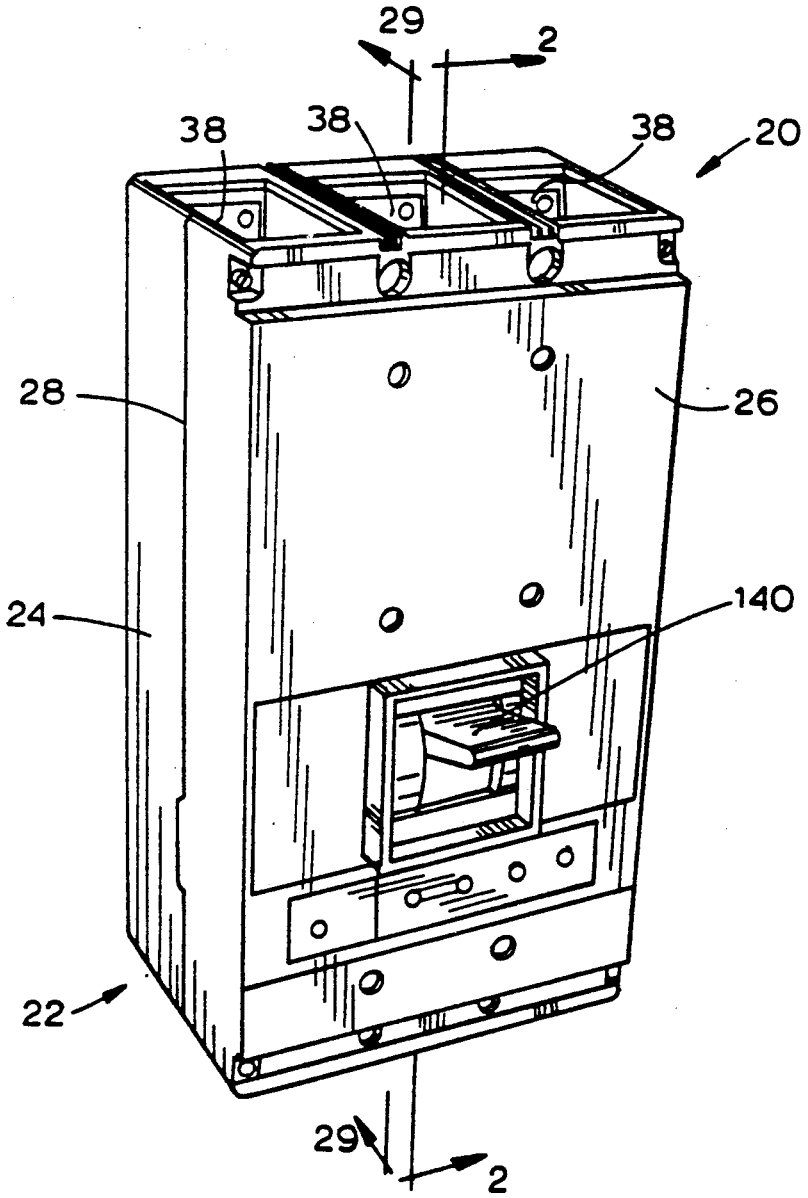
FIG. 1 is a perspective view of the molded case circuit breaker in accordance with the present invention.

Referring to the drawing and in particular to FIG. 1, a molded case circuit breaker, generally identified with the reference numeral 20, comprises an insulated housing 22, formed from a molded base 24 and a molded cover 26, assembled at a parting line 28. The circuit breaker 20 also includes at least one pair of separable main contacts 30 (FIGS. 2–4), provided within the insulated housing 22, which includes a fixed main contact 32 and a movably mounted main contact 34. The fixed main contact 32 is carried by a line side conductor 36, rigidly secured relative to the molded base 24. The line side conductor 36, in turn, is electrically connected to a line side terminal 38 (FIG. 1) for connection to an external electrical circuit (not shown).

Figure 2:
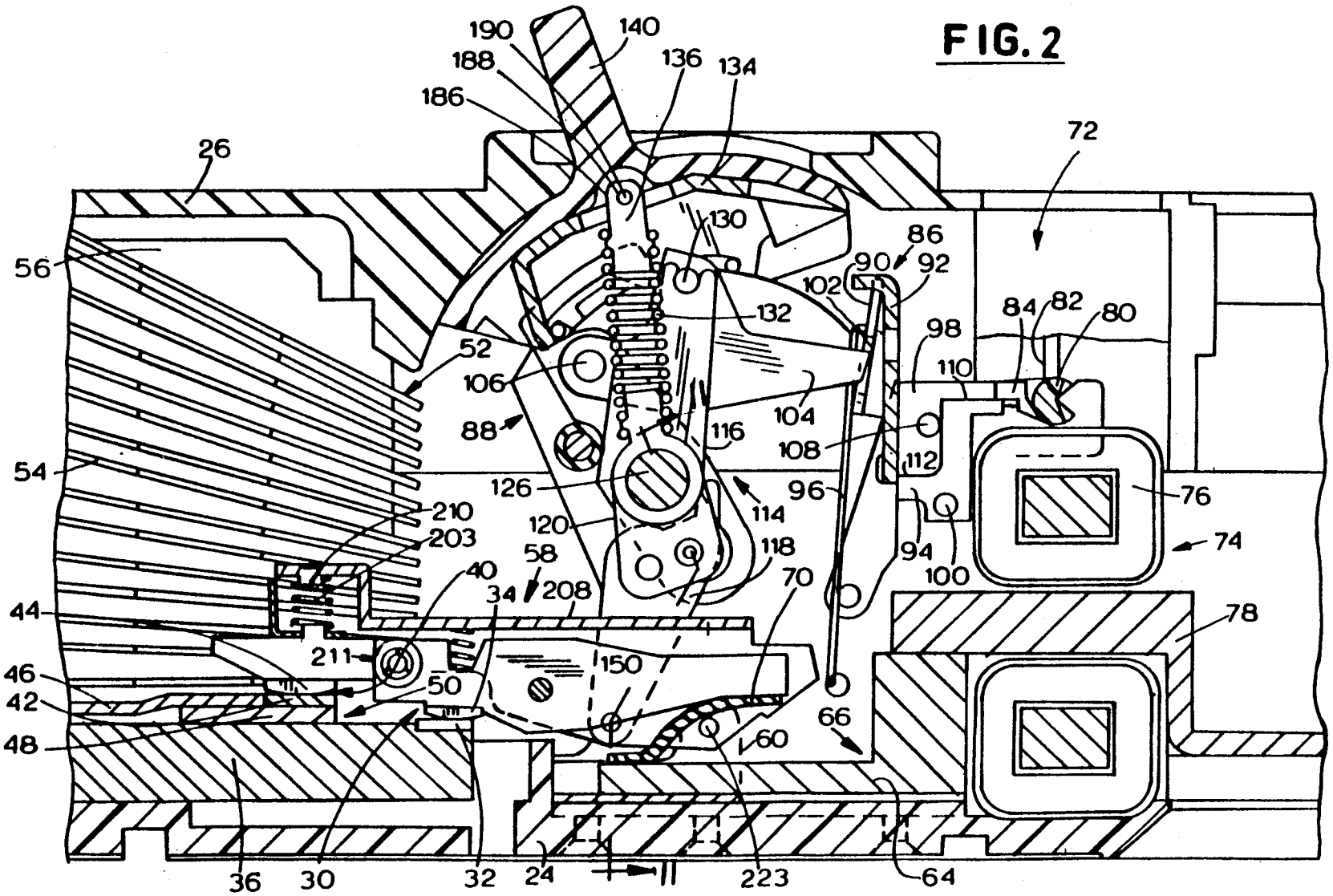
FIG. 2 is a cross-sectional view along line 2—2 of FIG. 1 illustrating the circuit breaker in an ON position.
Figure 3:
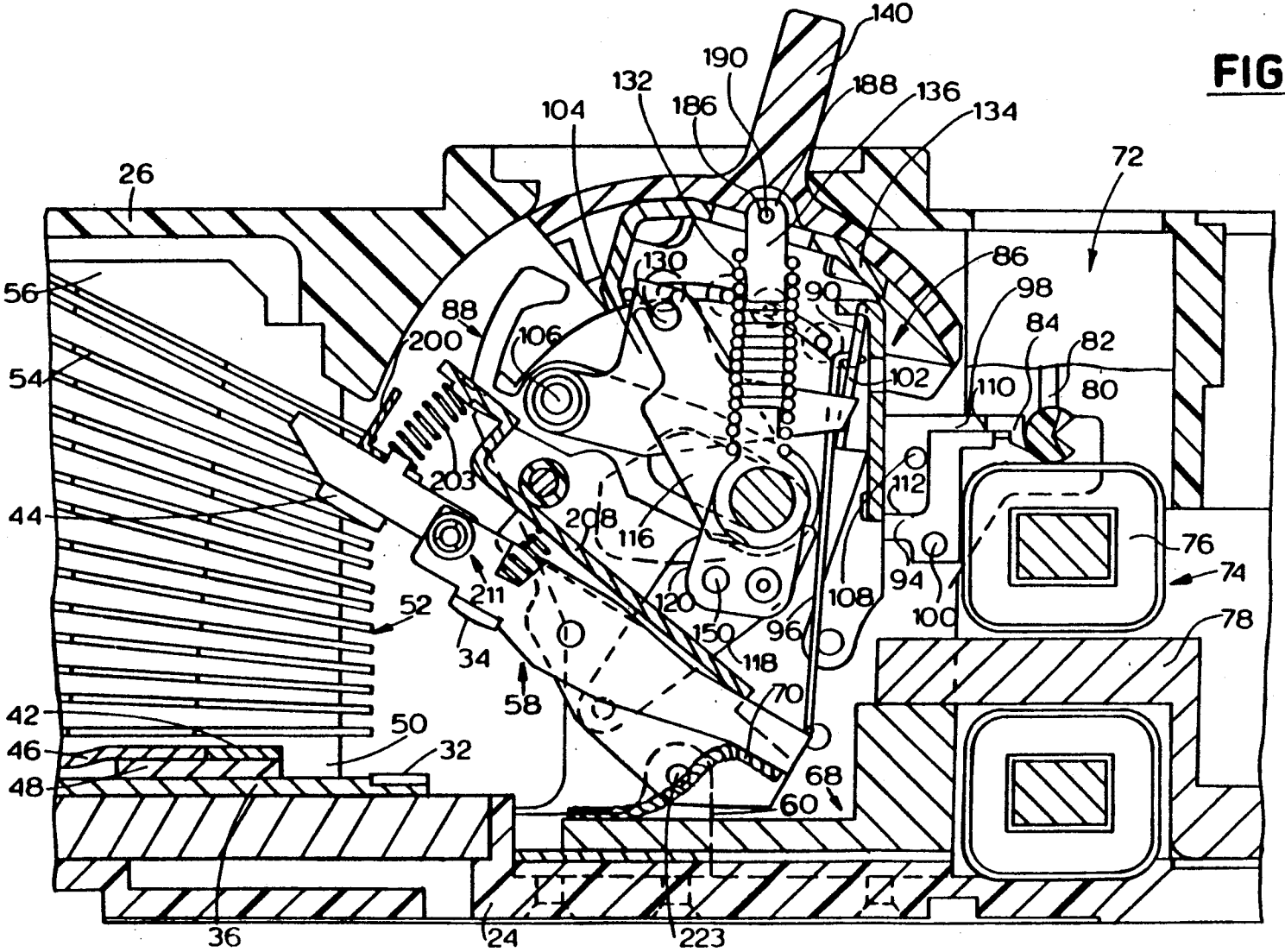
FIG. 3 is similar to FIG. 2 illustrating the circuit breaker in an OFF position.
Figure 4:
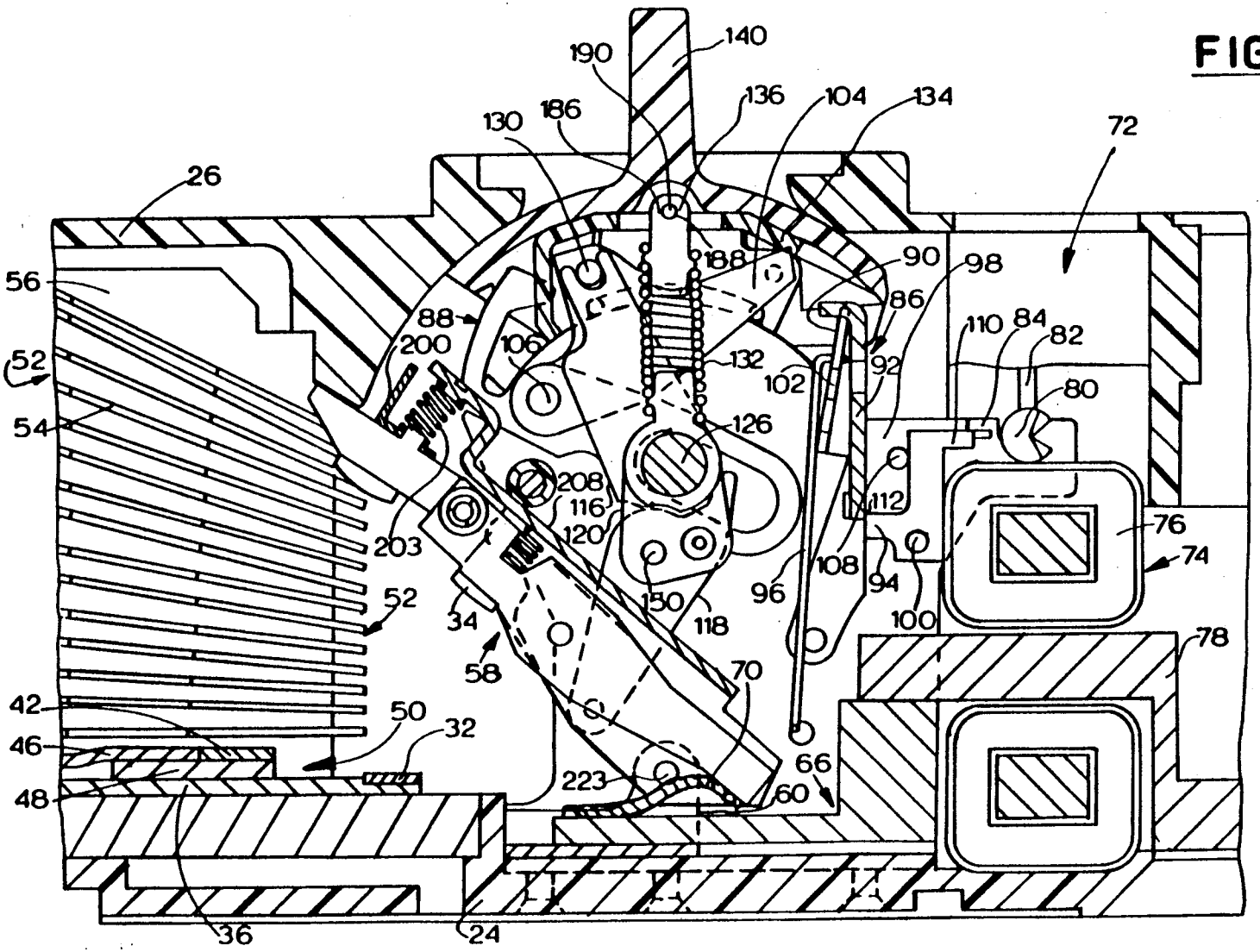
FIG. 4 is similar to FIG. 2 illustrating the circuit breaker in a TRIP position.

In order to decrease the wear on the separable main contacts 30, a plurality of arcing contacts 40 are provided (FIGS. 2–4). The arcing contacts 40 include one or more fixed arcing contacts 42 and one or more movably mounted arcing contacts 44. As will be discussed in more detail below, the mechanical coupling between the movably mounted arcing contacts 44 and the movably mounted main contacts 34 allows the arcing contacts 40 to close before the separable main contacts 30 when the circuit breaker 20 is placed in an ON position and allows the arcing contacts 40 to open after the main contacts 30 when the circuit breaker 20 is placed in an OFF position.

The line side conductor 36 carries the fixed arcing contact 42. More specifically, a plate 46 is rigidly secured to the line side conductor 36 on one end and spaced apart therefrom on the opposite end. The fixed arcing contact 42 is rigidly secured to another plate 48, for example, by welding or brazing forming a fixed arcing contact assembly 50. The fixed arcing contact assembly 50 is, in turn, sandwiched between the plate 46 and the line side conductor 36 and rigidly secured therebetween, for example, with fasteners (not shown) to facilitate replacement of the fixed arcing contact assembly 50.

Disposed adjacent a fixed main contact 32 and the fixed arcing contact 42 is an arc chute assembly 52. The arc chute assembly 52 facilitates extinguishment of arcs generated by separation of the main contacts 30 and the arcing contacts 40. As the arc is extinguished in the arc chute assembly 52, a conductive gas is generated which is directed out dedicated vents (not shown) in the circuit breaker cover 26. The arc chute assembly 52 includes a plurality of spaced apart arc plates 54 carried by a pair of spaced apart sidewalls 56.

As will be discussed in more detail below, a movably mounted main contact arm assembly 58 carries the movable contact 34. The movably mounted contact arm assembly 58 is pivotally mounted with respect to the molded base 24. More specifically, an L-shaped bracket 60 (FIG. 5) is provided which defines a pair of spaced apart depending legs 62 interconnected by a connecting leg 64. A generally L-shaped load conductor 66 is disposed on top of the connecting leg 64. The load conductor 66 and the connecting leg 64 are, in turn, rigidly secured to the molded base 24 with a plurality of fasteners (not shown).

The depending legs 62 are provided with aligned apertures 68. As will be discussed in more detail below, the movably mounted contact arm assembly 58 is pivotally connected to the L-shaped bracket 60 by way of the apertures 68. The movably mounted contact arm assembly 58 is also electrically connected to the load conductor 66 by way of a plurality of flexible shunts 70 (FIG. 5), formed from, for example, braided copper conductor, for example, by welding or brazing.

Disposed adjacent the load conductor 66 is an electronic trip unit 72 (FIGS. 2–4). The electronic trip unit 72 does not form a portion of the present invention and is described briefly only to provide a better understanding of the invention. Such electronic trip units are generally known in the art. For example, one known electronic trip unit is disclosed in U.S. Pat. No. 3,783,423, hereby incorporated by reference.

The electronic trip unit 72 includes a current transformer 74 for each phase for sensing load current. The current transformers 74 are formed in a generally donut shape with a plurality of secondary windings 76 disposed about a load conductor 78.

The load conductor 78 is formed in a generally L-shape and is rigidly secured on one end to the load conductor 66 as well as to the molded base 24 with a plurality of fasteners (not shown) . The free end (not shown) of the load conductor 78 acts as a load terminal for connection to an external load, such as a motor.

When the main contacts 30 are in an ON position as shown in FIG. 2, the load current flows from the line side conductor 36 through the main contacts 30 and the arcing contacts 40 to load side conductors 66 and 78 to the electrical load. The load current through the load conductor 78 induces a current into the secondary windings 76 of the current transformer 74. The current in the secondary windings 76 is, in turn, applied to an overcurrent trip circuitry (not shown) disposed within the electronic trip unit 72 for initiating a trip of the circuit breaker 20 for predetermined levels of overcurrent. More specifically, the electronic trip unit 72 includes a trip bar 80 (FIGS. 2–4) having an integrally formed extending trip lever 82. The trip lever 82 is mechanically coupled to a flux shunt trip assembly (not shown) which cooperates to rotate the trip bar 80 in a clockwise direction (FIG. 2) during predetermined levels of overcurrent. Upon rotation of the trip bar 80, a latch lever 84, integrally formed on the trip bar 80, releases a latch assembly 86 to allow the circuit breaker 20 to trip.

LATCH ASSEMBLY

The latch assembly 86 latches the circuit breaker operating mechanism, generally identified with the reference numeral 88, during conditions when the circuit breaker 20 is in an ON position as shown in FIG. 2 and when the circuit breaker 20 is placed in an OFF position as shown in FIG. 3. However, during an overcurrent condition, the electronic trip unit 72, and more specifically, the trip bar 80 releases the latch assembly 86 to allow the circuit breaker 20 to trip as shown in FIG. 4.

The latch assembly 86 includes a pivotally mounted lock plate 90, a latch plate 92, a latch lever 94 and a biasing spring 96. The lock plate 90 is pivotally mounted to a pair of spaced apart side plates 98, best shown in FIG. 25, used to carry the operating mechanism 88. The latch plate 92 is coupled to the latch plate 90 at one end. The other end of the lock plate 92 is mounted for arcuate movement within the side plates 98. The lock plate 90 includes a pair of spaced apart notches 102 for latching a cradle 104 which forms a portion of the operating mechanism 88 as will be discussed below in more detail. The biasing spring 96 biases the lock plate 90 and the latch plate 92 in a counterclockwise direction.

The latch lever 94 is pivotally mounted to one of the side plates 98 by way of a pin 100. The latch lever 94 is biased in a counterclockwise direction by a torsion spring (not shown). A stop pin 108 serves to limit rotation of the latch lever 94 as well as the latch plate 92.

A The latch lever 94 is integrally formed with an upper latch surface 110 and a lower latch surface 112. The lower latch surface 112 is adapted to be received in a notch (not shown) in the latch plate 92 to maintain the lock plate 90 and latch plate 92 in a latched position as shown in FIGS. 2 and 3. The upper latch surface 110 is adapted to communicate with the latch lever 84 formed on the trip bar 80 which releases the cradle 104 upon detection of an overcurrent condition by the electronic trip unit 72 as shown in FIG. 4. After the latch assembly 86 is unlatched, the circuit breaker must be placed in the OFF position as shown in FIG. 3 to reset it.

OPERATING MECHANISM

Figure 5:
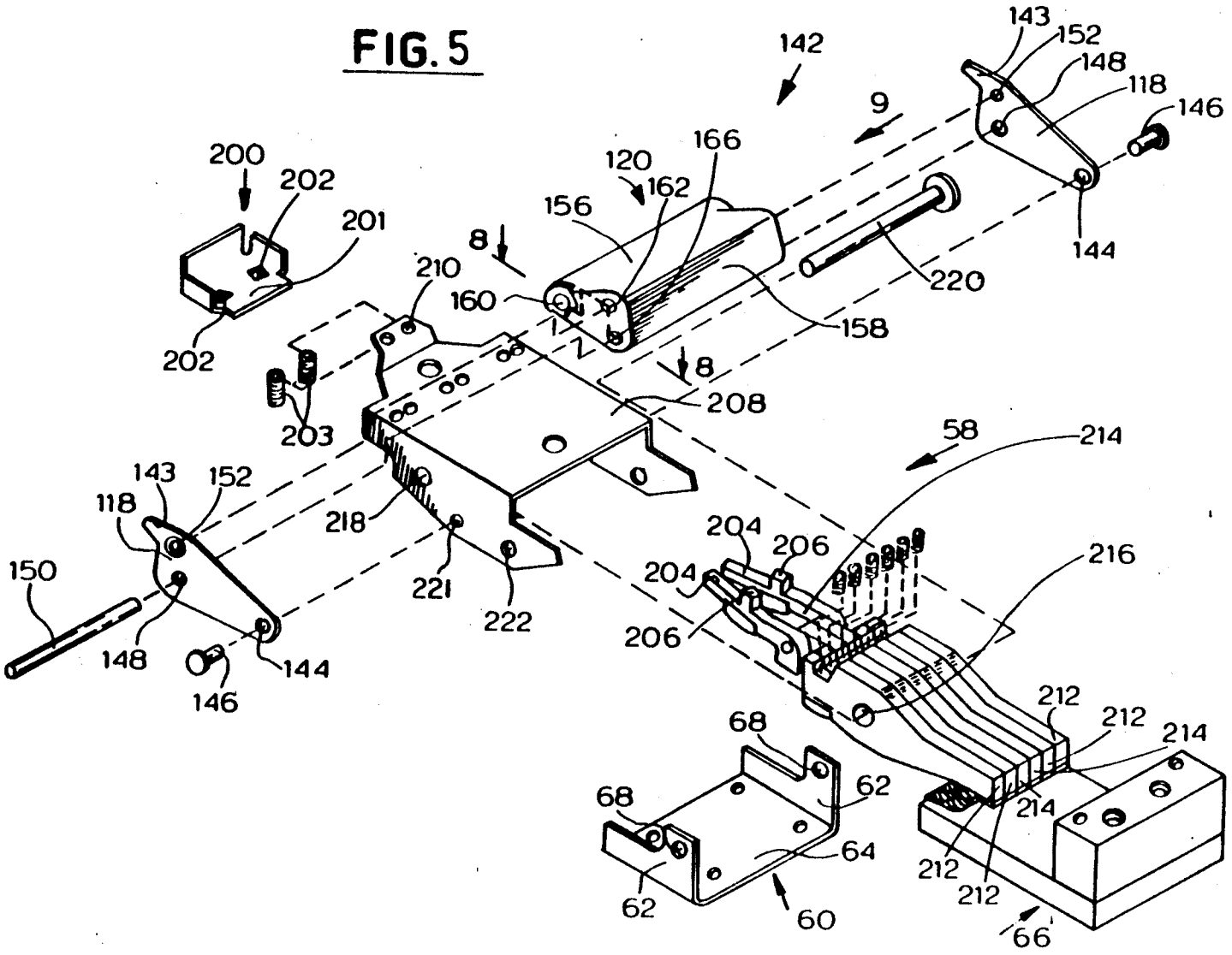
FIG. 5 is an exploded perspective view of a movable contact arm assembly, a high interrupting current assembly and an arcing contact spring housing in accordance with the present invention.

An operating mechanism 88 is provided for opening and closing the separable main contacts 30. The operating mechanism 88 includes a toggle assembly 114 which includes a pair of upper toggle links 116 (FIGS. 2, 3, 4 and 6), a pair of trip links 118 (FIGS. 1, 5 and 7) and an insulator link 120 (FIGS. 5, 8 and 9). In one embodiment of the invention, the upper toggle link 116 is formed as an irregular shaped member having an aperture 124 for receiving a crossbar 126 (FIGS. 2–4 and 28). Each of the upper toggle links 116 is also provided with a notch 128 which allows it to be mechanically coupled to the cradle 104 by way of a pin 130 (FIGS. 2–4). Operating springs 132 (FIGS. 2–4 and 29) are connected between the crossbar 126 and a handle yoke 134 by way of spring retainers 136 as will be discussed in more detail below.

The cradle 104 may be formed from a pair of oppositely disposed, irregular-shaped members. One end of each of the cradle members 104 is pivotally connected to each of the side plates 98 by way of the pin 106. The cradle members 104, in cooperation with the latch assembly 86 allows the circuit breaker 20 to be tripped by way of the electronic trip unit 72. More specifically, when the cradle members 104 are in the position shown in FIG. 2, the separable main contacts 30 are under the control of an extending operating handle 140, rigidly secured to the handle yoke 130 to enable the circuit breaker 20 to be placed in an OFF position as shown in FIG. 3. Similarly, the operating handle 140 may also be used to place the circuit breaker 20 in an ON position. However, upon detection of an overcurrent, the electronic trip unit 72 releases the latch assembly 86 which, in turn, releases the cradle 104 to allow the circuit breaker main contacts 30 to be tripped as shown in FIG. 4 under the influence of the operating springs 132. In order to reset the cradle 104, it is necessary to rotate the operating handle 140 to the OFF position (FIG. 3) which, in turn, allows the cradle members 104 to be latched relative to the latch assembly 86. Once the cradle members 104 are latched, the operating handle 140 may be used to place the main contacts 30 in the ON position.

HIC ASSEMBLY

An important aspect of the invention relates to a high interrupting current (HIC) assembly 142 (FIG. 5). The HIC assembly 142 allows for interruption of relatively large magnitude overcurrents, such as short circuit currents, for example, 100,000 amperes or more, as a result of magnetic repulsion forces generated by the shunts 70. The HIC assembly 142 is adapted to uncouple the movably mounted contact arm 58 from the operating mechanism 88 during such conditions. Moreover, the HIC assembly 142 in accordance with the present invention offers distinct advantages over known blow open mechanisms, for example, as shown and disclosed in U.S. Pat. No. 4,891,618, assigned to the same assignee as the present invention. More specifically, in that system, the pivotally mounted contact arm is mechanically coupled to the operating mechanism by way of a cam roll pin assembly. When relatively large magnitude overcurrents, such as a short circuit current, the cam roll pin assembly allows the movably mounted contact arm to be uncoupled from the operating mechanism by way of relatively large magnetic repulsion forces generated in flexible shunts used to electrically connect the pivotally mounted contact arm to the load side conductor.

There are several problems with a blow open assembly as described in the aforementioned U.S. patent. First, such an assembly requires a substantial amount of space within the circuit breaker. For relatively large frame size circuit breakers, such as a 1600/2000 ampere frame size circuit breaker, such an assembly is suitable. However, for relatively smaller frame size circuit breakers, such as a 1200 ampere frame size breaker, such an assembly requires relatively more space than is available. Secondly, such an assembly can be difficult to calibrate to vary the magnitude of overcurrent at which the assembly blows open. More specifically, in the assembly disclosed in above-mentioned U.S. patent, the electrical current at which the movable contact arm assembly is uncoupled from the operating mechanism is largely dependent upon the cam roll pin assembly. More specifically, the cam roll pin assembly mechanically couples the movable main contact arm to the operating assembly by way of a cam roll pin which is carried by a cam formed on the movable contact arm assembly. A plurality of biasing springs are used to couple the cam roll pin to the cam surface on the movable contact arm assembly. In such a design, the blow open current is dependent upon the interrelationship of the cam design as well as the force of the biasing springs and thus is relatively difficult to adjust.

The HIC assembly 142 in accordance with the present invention solves such problems. More specifically, the HIC assembly 142 facilitates adjustment of the electrical current at which blow open occurs. Moreover, the HIC assembly 142 requires relatively less space within a circuit breaker housing to allow the blow open feature to be incorporated into breakers having relatively smaller frame sizes, such as a 1200 ampere frame size circuit breaker.

The HIC assembly 142 includes the insulator link 120 (FIGS. 5, 8 and 9) and a pair of trip links 118 (FIGS. 5 and 7). During normal operating conditions and relatively low magnitude overcurrent conditions, the trip link 118 couples the movably mounted contact arm assembly 58 to the operating mechanism 88. More specifically, during such conditions, the trip link 118 is coupled to the insulator link 120 and in conjunction with the upper toggle link 116 forms the toggle assembly 114 to allow the circuit breaker to be selectively placed in the ON position as shown in FIG. 2 or alternatively in the OFF position as shown in FIG. 3 under the control of the operating springs 132 by actuation of the operating handle 140.

During relatively low magnitude overcurrent conditions, the trip link 118 remains coupled to the insulator link 120 to allow the circuit breaker 20 to be tripped by the electronic trip unit 72, as illustrated in FIG. 4. In this condition, the electronic trip unit 72 causes cradle 104 to be unlatched from the latch assembly 86 to allow the movably mounted contact arm 58 to be rotated upwardly under the influence of the operating springs 132 as previously mentioned.

Figure 10:
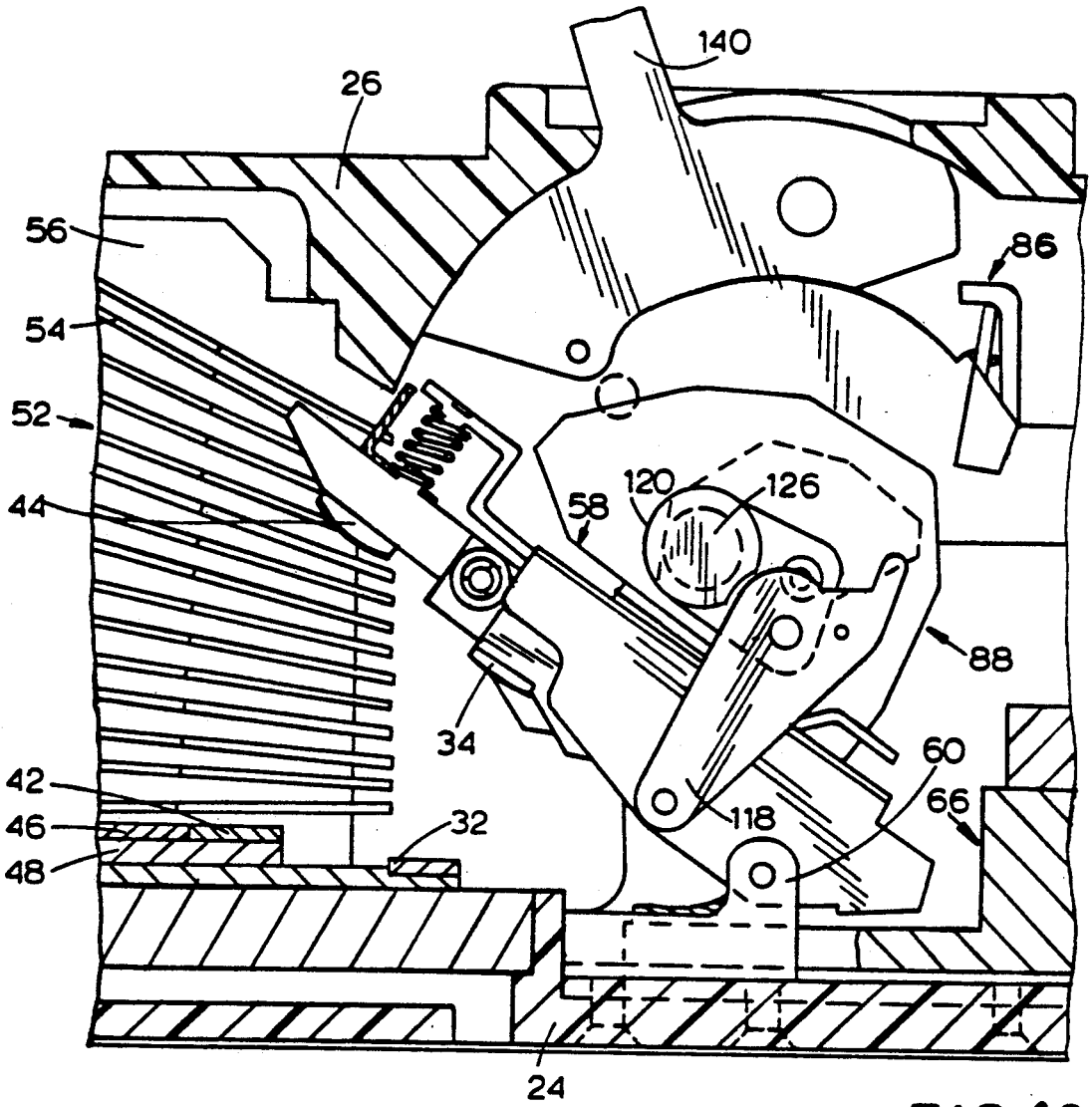
FIG. 10 is similar to FIG. 2 illustrating the circuit breaker in accordance with the present invention in a blown open position.

During relatively large magnitude overcurrent conditions, such as a short circuit condition, the HIC assembly 142 uncouples the operating mechanism 88 from the movable contact arm assembly 58 to allow the separable main contacts 30 to be blown open before the electronic trip unit 72 has time to react. In this condition, magnetic repulsion forces generated in the shunts 70 uncouple the trip link 118 from the insulator link 120 to allow the movably mounted contact arm assembly 58 to be blown open to the position as shown in FIG. 10.

The trip links 118, are best illustrated in FIGS. 5 and 7. One trip link 118 is pivotally connected on each side of the movably mounted contact arm assembly 58 as shown in FIG. 5. Each trip link 118 is formed from an irregular shape with an extending finger portion 143 formed on one end. The extending finger portion 143 is adapted to engage the insulator link 120 during conditions when the trip link 118 is coupled thereto. An aperture 144 disposed adjacent one end to allow pivotal attachment of the trip link 118 to the movably mounted contact arm assembly 58 by way of a pin 146 (FIGS. 5 and 10). Another aperture 148, spaced apart from the aperture 144 allows the pivotal connection of the trip link 118 relative to the insulator link 120 by way of another pin 150.

A third aperture 152 is provided on the trip link 118 for coupling the trip link 118 to the insulator link 120. More specifically, the aperture 152 forms a detent for capturing a spring-loaded detent ball 154 (FIG. 11) disposed on opposing ends of the insulator link 120 as will be discussed below. Spring-loaded detent balls 154 as well as the design of the aperture 152, control the magnitude of electrical current at which blow open of the contacts occurs. More specifically, the detent ball diameter and/or the diameter of the aperture 152 may be varied to adjust the magnitude of electrical current at which blow open occurs. Additionally, the spring force on the detent balls 154 may also be varied. Also, the aperture 152 may be countersunk and chamfered. In such an embodiment, the chamfer angle may be varied in order to adjust the blow open current.

Figure 11:
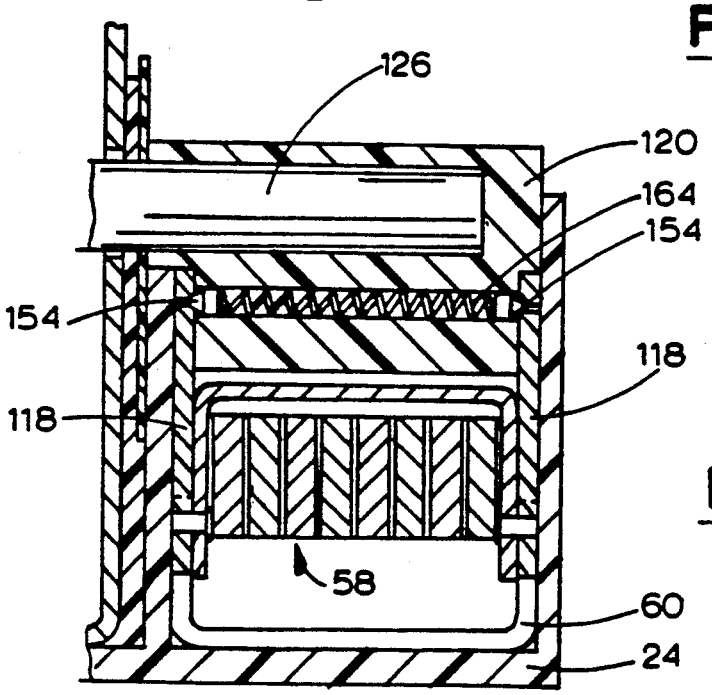
FIG. 11 is a partial sectional view along line 11—11 of FIG. 10.

The insulator link 120 is formed from an electrically insulated material including a cylindrical portion 156 and an irregular-shaped portion 158. The cylindrical-shaped portion 156 includes a centrally disposed bore 160 for receiving the crossbar 126. The irregular-shaped portion 158 also includes a bore 162 for receiving a biasing spring 164 and the detent balls 154 as best shown in FIG. 11. More specifically, biasing spring 164 is disposed in the bore 162. Detent balls 154 are then disposed on opposite ends of the bore 162. The biasing spring 164 biases the detent balls 154 outwardly to apply an outward force against the trip link 120.

The irregular-shaped portion 158 also includes a bore 166 that is adapted to be aligned with the bores 148 in the trip links 118. The pin 150 is then inserted in the aligned bores 148 and 166 to provide a pivotal connection between the insulator link 120 and the trip links 118.

During a relatively large overcurrent condition, such as a short circuit condition, magnetic repulsion forces are created between the shunts 72. These magnetic repulsion forces exert a clockwise moment on the movably mounted contact arm assembly 58 before the electronic trip unit 72 has time to react. In such a situation, the crossbar 126 will be stationary, thus causing the trip links 118 to pivot relative to the insulator link 120. More specifically, since the crossbar 126 is stationary in this condition, the clockwise moment on the movably mounted contact arm assembly 58 forces the detent balls 154 inward against the pressure of the biasing spring 164 to allow the trip links 118 to rotate relative to the insulator link 120 to the position as shown in FIG. 10 to allow the movably mounted contact arm 58 to blow open.

Handle Yoke With Rollers

In order to conserve space within the circuit breaker housing 22, the handle yoke 134 is supported with a plurality of rollers 170 (FIGS. 12–16) relative to the side plates 98. By supporting the handle yoke 134 with rollers 170 on the side plates 98, the virtual pivot axis for the handle yoke 134 can be maintained while at the same time allowing the same space to be used for the crossbar 126. More specifically, in known circuit breakers, such as disclosed in U.S. Pat. No. 4,891,618, the handle yoke is formed as a generally Unshaped member defining a pair of depending legs which are rounded on the free ends. These rounded free ends are disposed in notches formed in the side plates to allow rotation of the handle yoke. Because of the size of the handle yoke and the degree of rotation between an ON position and an OFF position, a substantial amount of space within a circuit breaker is required. Consequently, no other components can be located within such space since they would interfere with the movement of the handle yoke. Accordingly, in such a circuit breaker, the crossbar assembly, mechanically interlocked to the movably mounted contact arm, must be spaced away from the space occupied by the handle yoke. For circuit breakers with relatively large frame sizes, such as a 1600/2000 ampere frame size, such space within the base is normally available. However, with relatively smaller frame size circuit breakers, such as a 1200 ampere frame size, space within the breaker housing is at a premium. The present invention is adapted to be used in such relatively smaller frame size circuit breakers, such as a 1200 ampere frame size. In order to conserve space, the handle yoke 134 is supported by rollers 170 relative to the side plates 98 to essentially maintain the same virtual pivot axis for the handle yoke 134 necessary to accomplish the circuit breaker operations. At the same time, the crossbar 126 can be located within the space normally occupied by the handle yoke pivot axis to conserve space within the housing.

Referring to the drawings and in particular FIGS. 12–15, the side plates 98, which normally carry the circuit breaker operating mechanism 88, are formed with curved surfaces 172. The radius R of such curved surfaces 172 is such to allow the circuit breaker 20 to accomplish all of its normal mechanical operations. More specifically, as shown in FIG. 12, the radius R of the curved surfaces 172 defines a virtual pivot axis 174. As shown in FIGS. 12 and 13, the virtual pivot axis 174 is located in a window 176 in the side plates 98 where the crossbar 126 is located in order to conserve space within the housing 22.

The handle yoke 134, best illustrated in FIG. 16, is formed from a piece of flat steel stock, stamped and formed into the shape illustrated. The handle yoke 134 is formed in a generally U-shape defining a bight portion 176 and two generally depending arm portions 178. Slots 180 are provided between the bight portion 176 and the depending arm portions 178 to allow free travel of the cradle 104 and the upper toggle links 116. The bight portion 176 is also formed with a plurality of slots 182 for receiving spring retainers 136 (FIGS. 2–4) for the operating springs 132. More specifically, the spring retainers 136 are formed with extending arm portions 186 with apertures 188, formed intermediate the end. The spring retainers 136 are inserted into the slots 182 such that the apertures 188 in the spring retainers 136 extend upwardly from the bight portion 176 of the handle yoke 134. A pin 190 is inserted through the apertures 188 to couple the handle yoke 134 to one end of the operating springs 132. The other end of the operating springs 132 are coupled to the crossbar 126.

The depending arm portions 178 of the handle yoke 134 are disposed adjacent the curved surfaces 172 on the side plates 98 as best shown in FIGS. 12–15. A pair of notches 192 are provided in each of the depending arm portions 178. The length of the notches 192 are sized such that when the handle yoke 134 is at the midpoint of travel between oppositely disposed stop surfaces 193 formed in the side plates 98, the length of each notch 192 is one half of the distance to the stop surface 193. These notches 192 allow for travel of the rollers 170 relative to the handle yoke 134. The notches 192 also define projections 194, 196 and 198. More specifically, projections 194 and 198 are defined on each end of the depending arm portions 178 of the handle yoke 134. A projection 196 is defined intermediate the two notches 192. The projections 194, 196 and 198 facilitate orientation of the rollers 170 relative to the handle yoke 134 in the event of slippage. More specifically, as shown in FIG. 13, when the circuit breaker 20 is in an OFF position, the rollers 170 are disposed adjacent the left projection 194 and the center projection 198. When the circuit breaker operating handle 140 is moved toward the ON position as shown in FIG. 5, the rollers 170 are rotated in a counterclockwise direction until the opposing side of the center projection 196 and the right projection 198 engage the handle rollers 170. Thus, in the event of slippage of the handle rollers 170 relative to the handle yoke 134, the notches 192 and the curved surfaces 172 on the depending arm portions 178 of the handle yoke 134, serve to properly orientate the position of the rollers 170 relative to the handle yoke 134.

The end projections 194 and 198 also reduce tilting of the handle yoke 134 relative to the curved surf aces 172 on the side plates 98 in the event that an excessive amount of force is applied to the circuit breaker operating handle 140. In such a situation, the end projections 194 and 198 form pivot axes for any tilting action of the handle yoke 134 relative to the curved surface 172 on the side plate 98. By disposing the pivot axis during such a condition on the ends of the depending arm portions 178, any excessive force applied to the operating handle in either an ON position or an OFF position will be opposed by the force of the operating springs 132 used to couple the handle yoke 134 to the side plates 98 thus minimizing tilting of the handle yoke 194.

As shown best in FIG. 15, each roller 170 is formed with a pin 192 with rigidly mounted disks 194 mounted on each end. The space between the inwardly facing faces of the disks 194 is sized to be slightly greater than the width of the side plate 98. The spaced apart disks 194 capture the side plate 98 and provide axial stability of the handle yoke 134 relative to the side plate 98.

Arcing Contact Spring Housing

Another important aspect of the invention relates to the movably mounted arcing contacts 44 and in particular a housing for biasing springs for the arcing contact which shield the biasing springs from conductive gases generated during interruption. More specifically, in known circuit breakers, such as the circuit breaker disclosed in U.S. Pat. No. 4,891,618, the contact pressure for the arcing contacts is provided by disposing a spring between the top surface of the arcing contact arm and the bottom surface of the contact arm carrier. In such a design, the arcing contact springs are subject to conductive gases which can deteriorate the springs causing a maloperation of the arcing contacts which, in turn, can result in damage to the arcing contacts as well as the main contacts.

In accordance with the present invention, a spring housing 200 (FIGS. 2–5) is formed from a piece of flat stock and formed in a generally box-shape with one open side and open on the top. One face 201 of the spring housing 200 is provided with a pair of spaced apart apertures 202, used for locating the spring housing 200 as well as biasing springs 203. More specifically, as shown best in FIG. 5, arcing contact arms 204 are provided with locating tabs 206. These locating tabs 206 are received in the apertures 202 in the spring housing 200 which function to locate the spring housing 200 relative to the arcing contact arm 204 and also to prevent longitudinal as well as transverse movement of the spring housing 200 relative to the arcing contact arm 204 after assembly.

The spring housing 200 is captured between the arcing contact arm 204 and a carrier 208. As shown in FIG. 5, the carrier 208 is formed in an L-shape at the free end. Tabs 210 are formed on the underside of the carrier surface adjacent the free end. One end of the biasing spring 203 is received over tab 210. The other end of the biasing spring 203 is disposed about the locating tab 206, formed on the arcing contact arm 204. The tabs 206 and 210 serve as spring retainers.

Clinch Joint Arcer Assembly

Figure 17:
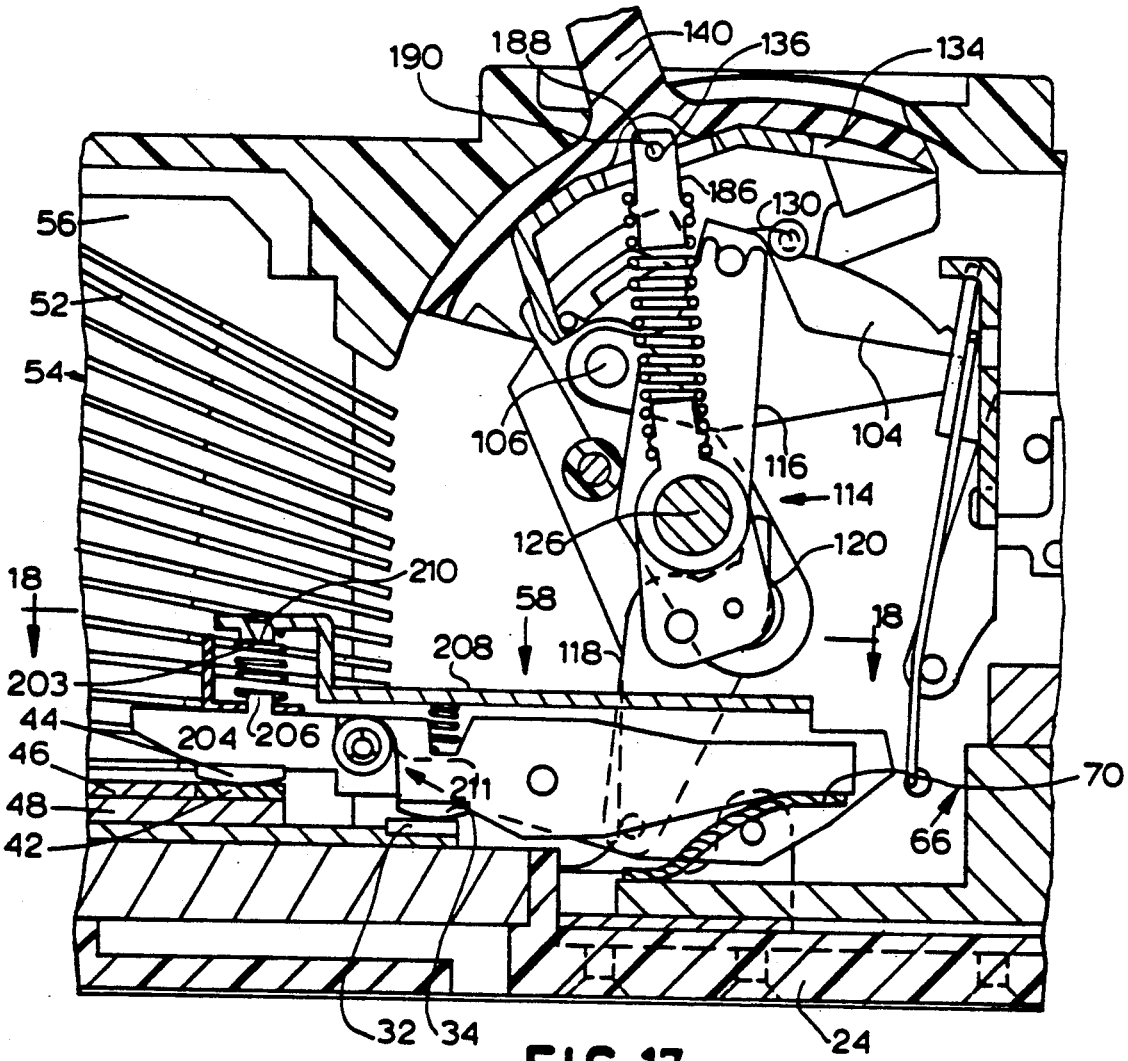
FIG. 17 is a sectional view similar to FIG. 2 illustrating the clinch joint arcing contact assembly with the circuit breaker in an ON position.
Figure 18:
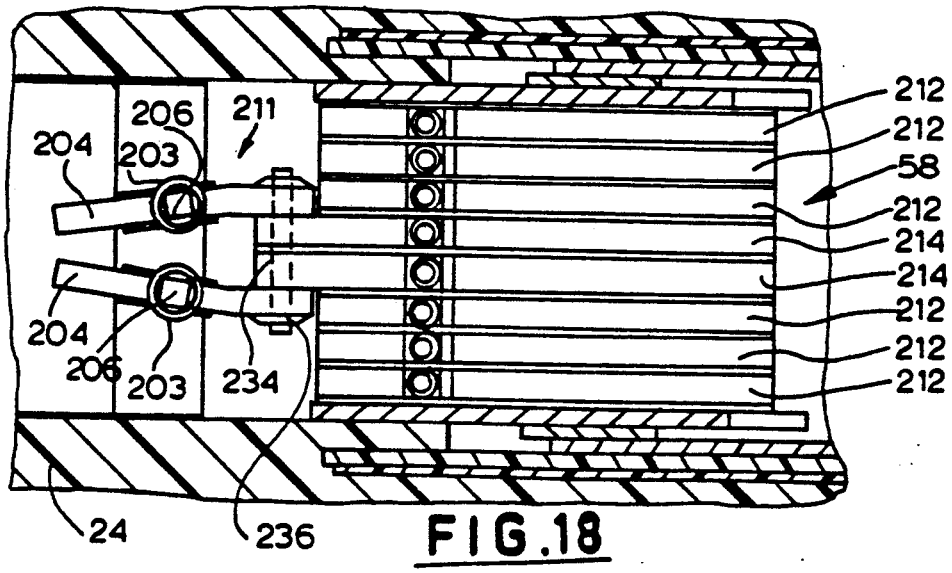
FIG. 18 is a sectional view along line 18—18 of FIG. 17.
Figure 19:
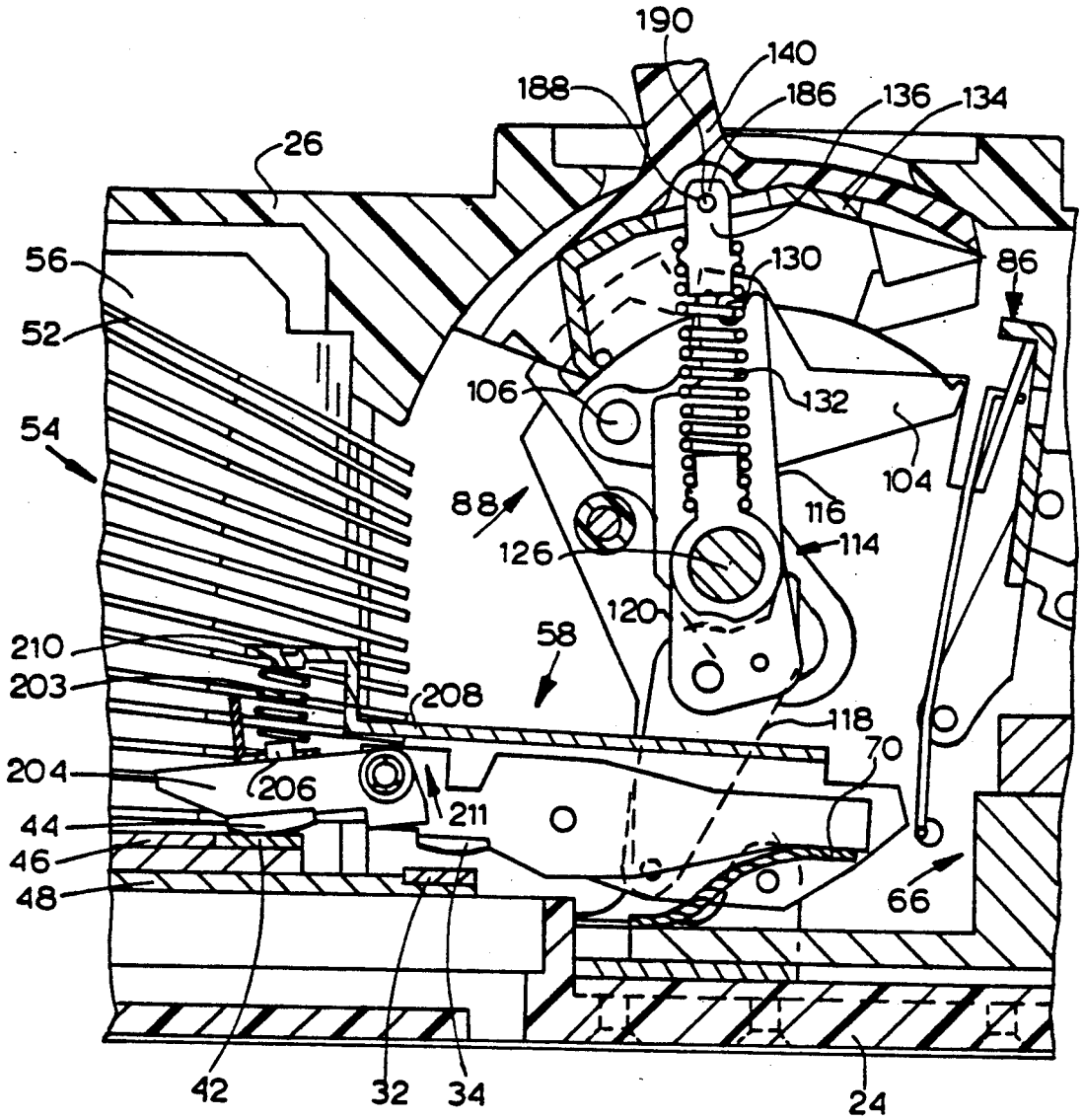
FIG. 19 is similar to FIG. 17 illustrating the separation of the main contacts while the arcing contacts remain in an ON position.

Another important aspect of the present invention relates to a clinch joint arcer assembly 211 as illustrated in FIGS. 17–19. The present invention offers several advantages over known movable arcing contacts. More specifically, such movable arcing contacts, such as disclosed in U.S. Pat. No. 4,891,638, are carried by separate arcing contact arms. The arcing contact arms are combined with a plurality of main contact arms to form a laminated contact arm assembly. The arcing contact arms as well as the main contact arms are pivotally mounted about a single pivot axis. By utilizing separate contact arms for the arcing contacts and the main contacts, the contact arm assembly occupies a relatively large amount of space within a circuit breaker housing. While such an assembly as disclosed in the aforementioned patent may be suitable for relatively larger frame size circuit breakers, it is not suitable in some cases for relatively smaller frame size circuit breakers, such as a 1200 ampere frame size breaker.

Arcing contacts are adapted to reduce wear on the circuit breaker main contacts as well as to reduce temperature rise within the circuit breaker housing during a circuit interruption. This is generally accomplished by forcing the main contacts to be opened before the arcing contacts in order to transfer the electrical current to the arcing contacts. In known circuit breakers, such as the circuit breaker disclosed in the aforementioned patent, the arcing contacts are generally placed at a relatively longer pivot radius than the main contacts. Since the contact arm assembly is normally in a slight overtravel position to create contact pressure between the main contacts and the arcing contacts, rotation of the contact arm assembly will generally cause the main contacts to be separated prior to the arcing contact since the arcuate travel of the main and arcing contacts will be different due to the difference in pivot radii for a given degree of rotation of the contact arms.

The present invention provides greater control of transfer of the electric current to the arcing contacts by placing the arcing contacts on a different pivot axis than the main contacts, which in conjunction with biasing springs, ensures that the main contacts are fully separated prior to separation of the arcing contacts. By providing more efficient transfer of the electric current from the main contacts to the arcing contacts, the wear on the main contacts is minimized.

Another advantage of the present invention is that the contact arm assembly, which may include a pair of arcing contacts, and a plurality, for example, six main contacts, requires less space in a circuit breaker housing than known contact arm assemblies, for example, as disclosed in U.S. Pat. No. 4,891,638. More specifically, the arcing contacts in accordance with the present invention are carried by arcing contact arms that are pivotally connected to contact arms that carry movable main contacts. By pivotally connecting the arcing contact arms to the main contact arms, the contact arm assembly in accordance with the present invention utilizes less space within the circuit breaker housing making it particularly suitable for circuit breakers with relatively small frame sizes, such as a 1200 ampere frame size.

As shown in FIGS. 5 and 17–19, the contact arm assembly 58 is formed from a plurality of main contact arms 212 and 214 and a pair of arcing contact arms 204. As will be discussed in more detail below, the main contact arms 214 are adapted to be pivotally connected to the arcing contact arms 204 by way of a clinch joint assembly 211. As best illustrated in FIG. 18, two main contact arms 214 are disposed between the main contact arms 212 to form a laminated contact arm assembly 58.

Each of the main contact arms 212 (FIG. 20) and 214 (FIG. 21) are provided with apertures 216 to allow the main contact arms 212 and 214 to be pivotally connected by way of aligned apertures 218 (FIG. 5), provided in the carrier 208 by way of a pin 220.

As best illustrated in FIG. 5, the carrier 208 is an irregular-shaped member formed with two additional pairs of aligned apertures 221 and 222. The aligned apertures 221 allow the carrier 208 to be pivotally connected to the trip link 118 by way of the pin 146. The aligned apertures 222 allow the carrier 208 to be pivotally connected to the bracket 60 by way of a pin 223 (FIGS. 2–4).

Figure 20:
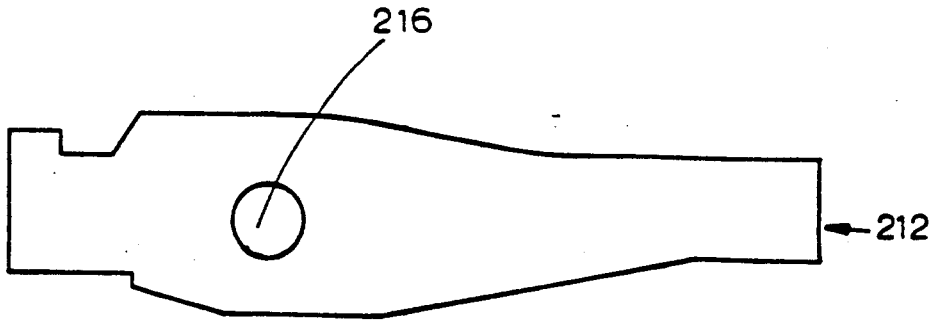
FIG. 20 is an elevational view of a main contact arm in accordance with the present invention.
Figure 21:
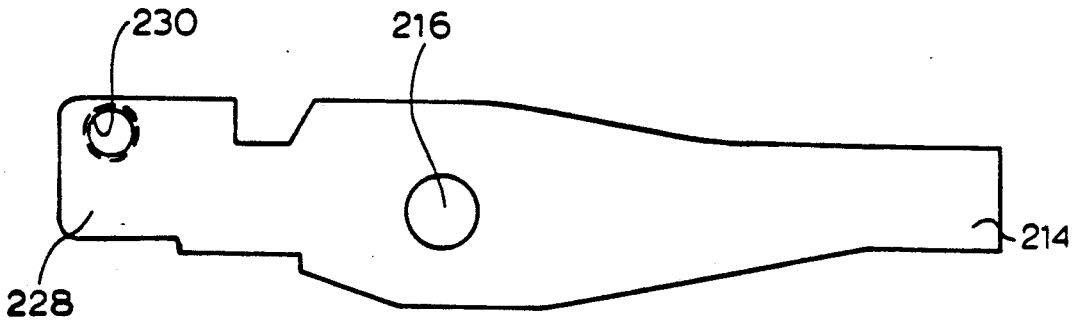
FIG. 21 is an elevational view of another main contact arm adapted to be pivotally connected to an arcing contact arm in accordance with the present invention.
Figure 22:
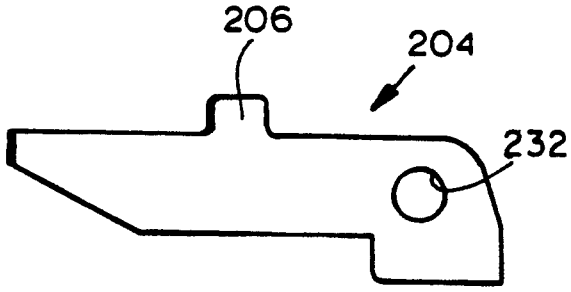
FIG. 22 is an elevational view of an arcing contact arm in accordance with the present invention.

The main contact arms 214 (FIG. 21) are formed to be relatively longer than the main contact arms 212 defining an extending portion 228 (FIG. 20). An aperture 230 is provided in the extending portion 228. This aperture 230 allows the arcing contact arms 204 to be pivotally connected thereto. More specifically, each of the arcing contact arms 216 (FIG. 22) is adapted to be disposed adjacent the extending portions 228 of, the main contact arms 214. The arcing contact arms 204 are formed with an aperture 232 on one end. The aperture 232 is adapted to be aligned with the apertures 230 in the extending portions 228 of the main contact arms 212. A clinch joint 211 assembly (FIG. 18) which includes a pin 234 and a plurality of spring washers 236 is used to connect the arcing contact arms 204 to the extending portions 228 on the main contact arms 214. By providing a clinch joint 211 the friction between the arcing contact arms 204 relative to the main contact arms 214 can readily be adjusted.

As best shown in FIG. 17, the circuit breaker 20 is illustrated in an ON position. In this position, both the main contacts 30 and the arcing contacts 40 are closed. During a trip or blow open condition, the clinch joint 211 allows the main contacts 30 to rather readily be separated prior to the arcing contacts 40. More specifically, FIG. 19 illustrates the position of the main contacts 30 as well as the arcing contacts 40 immediately after the initiation of a trip or blow open condition. In this condition, the contact arm assembly 58 begins to rotate in a clockwise direction as a result of the magnetic repulsion forces generated between depending legs of the flexible shunts 70, used to connect the movably mounted contact arm assembly 58 to the load side conductor 38. As the contact arm assembly 58 begins to rotate in a clockwise direction, the main contact arms 212 and 214 pivot in a clockwise direction as shown to separate the main contacts 30. Clockwise rotation of the main contact arms 212 and 214 causes the clinch joint pivot axis, defined by the pin 236, to move slightly upwardly under the influence of the biasing springs 203 disposed between the arcing contact arms 204 and the carrier 58, which, in turn, causes the arcing contact arm 216 to pivot in a counterclockwise direction. Accordingly, by placing the arcing contact arms 204 on a different pivot axis than the main contact arms 212 and 214, thus creating a two bar linkage, and taking advantage of the spring pressure of the biasing springs 203, the assembly rather efficiently transfers the electric current from the main contact arms 212 and 214 to the arcing contact arms 204 during an interruption. Moreover, by pivotally mounting the arcing contact arms 204 relative to the main contact arms 214, the assembly utilizes relatively less space within the circuit breaker housing 22 making it more suitable for circuit breakers having a relatively smaller frame size.

Positive Off Link

Positive off links are generally used to prevent the circuit breaker operating handle from being placed in an OFF position during a condition when the main contacts weld together, for example, during interruption of an excessive short circuit current. During such a condition, in order that the operating handle reflect the proper status of the circuit breaker contacts, it is necessary to provide a mechanism to prevent the circuit breaker operating handle from being placed in an OFF position when the main contacts are in fact welded. Various mechanisms are known for preventing the circuit breaker operating handle from being placed in an OFF position when the main contacts are welded. For example, U.S. patent application Ser. No. 07/511,700, filed on Apr. 20, 1990, assigned to the same assignee as the assignee of the present invention, discloses such a mechanism. However, that mechanism only prevents the circuit breaker operating handle from being placed in an OFF position and does not return the circuit breaker operating handle to the ON position afterward. Moreover, such a mechanism only prevents movement of the circuit breaker operating handle and cannot attempt to break the weld of the main contacts.

The positive off mechanism in accordance with the present invention solves such problems. First, the positive off mechanism in accordance with the present invention allows an operator to attempt to break the weld of the main contacts by applying a sufficient amount of force to the circuit breaker operating handle. In the event that the force applied to the operating handle is insufficient, the positive off mechanism in accordance with the present invention returns the operating handle to the ON position.

Figure 23:
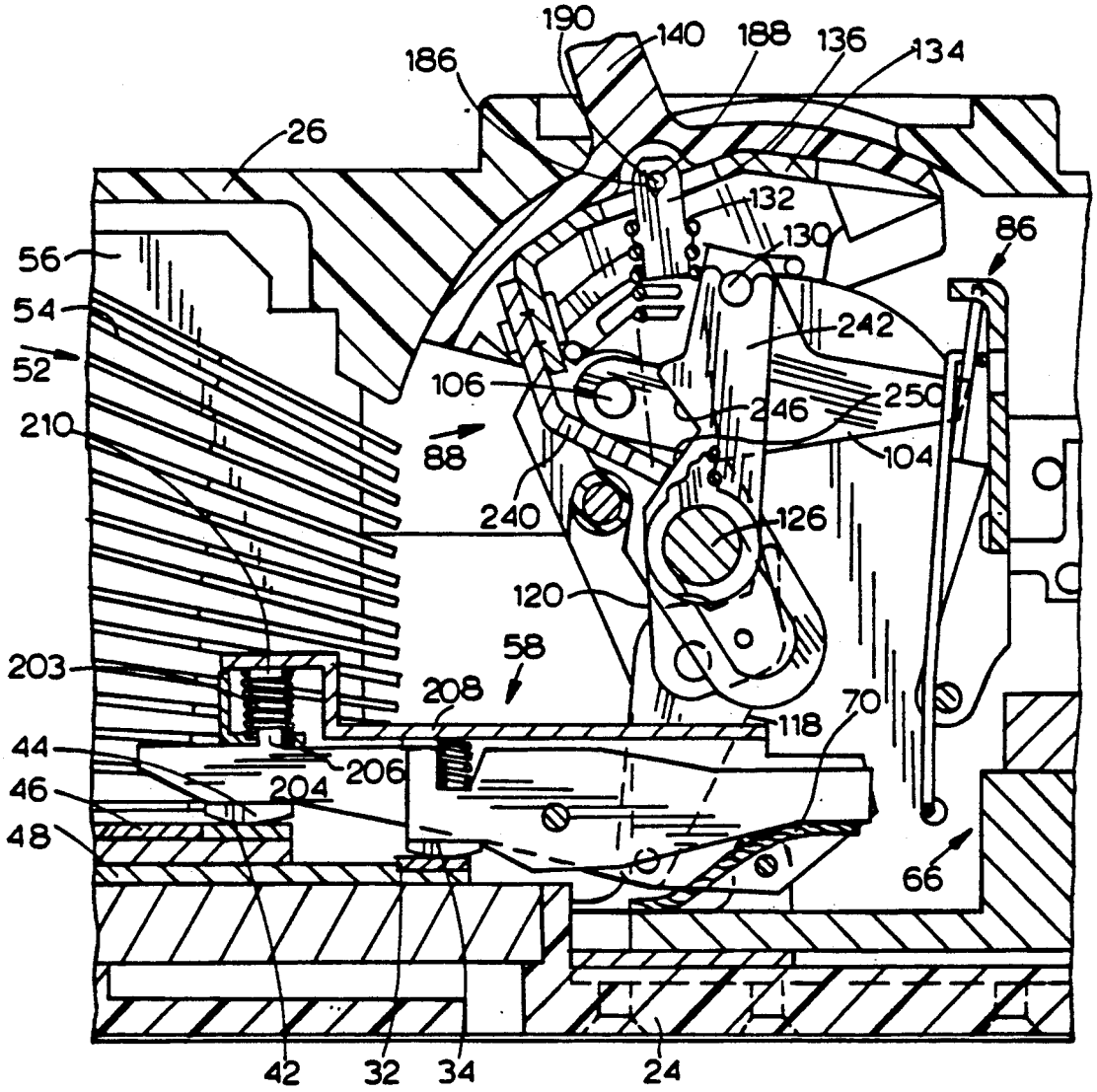
FIG. 23 is similar to FIG. 2 illustrating a positive off link in accordance with the present invention.
Figure 24:
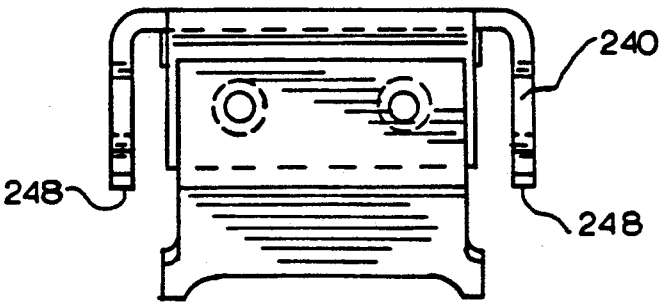
FIG. 24 is an elevational view of a weld bracket in accordance with the present invention.

Referring to the drawings and in particular FIGS. 23 and 24, the positive off mechanism in accordance with the present invention includes a weld bracket 240 and a modified upper toggle link 242. The weld bracket 240 is formed as a generally Unshaped member and is adapted to be rigidly connected to the handle yoke 134 with suitable fasteners 244. The modified upper toggle link 242 is similar to known toggle links except it is provided with a generally V-shaped notch 246 as shown in FIG. 19.

During normal conditions, the modified positive off link 242 does not interfere with the operation of the circuit breaker 20. More specifically, when the circuit breaker 20 is switched from an OFF position to an ON position, the upper link 242 generally lags behind the handle yoke 134. Moreover, when the circuit breaker 20 is moved f rom an ON position to an OFF position, the upper link 242 will travel in front of the handle yoke 134. However, during a contact weld position, the positive off link 242 can be used to attempt to break the weld and if unsuccessful, will return the operating handle 140 to the ON position. More specifically, during a contact weld position, free ends 248 of the weld bracket 240 will engage a stop face 250 formed on the positive off link 242 defined by the V-shaped notch 246 in the positive off link 242. The stop face 250 on the positive off link 242 is positioned to stop the handle yoke 134 before the operating mechanism 88 goes past the overcenter position, which prevents toggling of the toggle assembly 114.

By applying a sufficient amount of force to the operating handle 140, the free ends 248 of the weld bracket 240 will, in turn, apply force to the positive off link 242 to attempt to break the weld. If the weld cannot be broken, the operating handle 140 will be returned to the ON position under the influence of the operating springs 132 since the toggle assembly 114 is prevented from moving past the overcenter position.

Reversible Barrier

Figure 27:
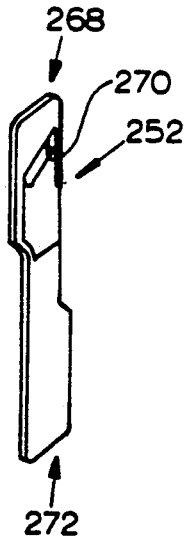
FIG. 27 is a perspective view of a reversible phase barrier in accordance with the present invention with an auxiliary contact switch partially removed.

Another important aspect of the present invention relates to a reversible barrier 252 (FIG. 27). As mentioned earlier, the circuit breaker housing includes a molded base 24 and a coextensive cover 26. The molded base 24 is formed with one or more integrally formed sidewalls 254. These sidewalls 254 generally act as interphase gas barriers to prevent conductive gases generated during a circuit interruption from causing either phase to phase or phase to ground faults within the circuit breaker housing 22. The sidewalls 252 are generally formed as solid members to allow them to be used as interphase gas barriers.

Figure 25:
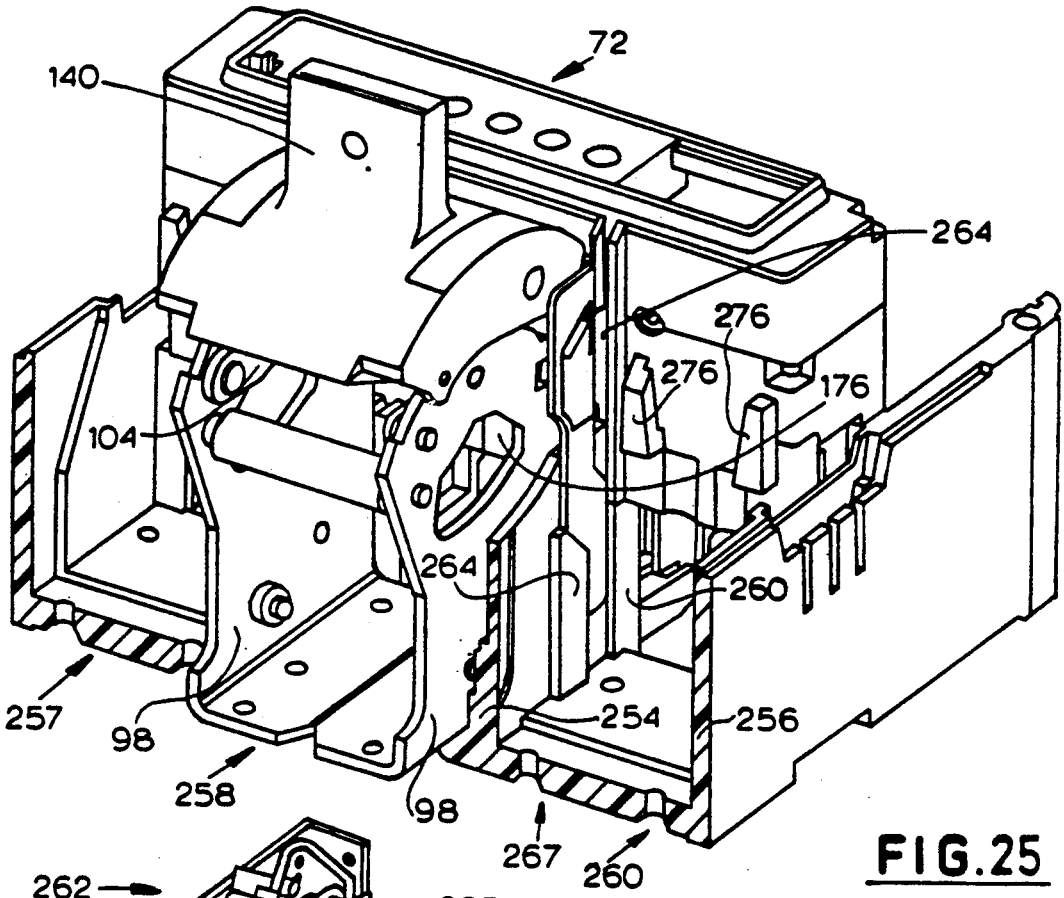
FIG. 25 is a partial perspective view of a circuit breaker illustrating a reversible phase barrier in accordance with the present invention in a first position.
Figure 28:
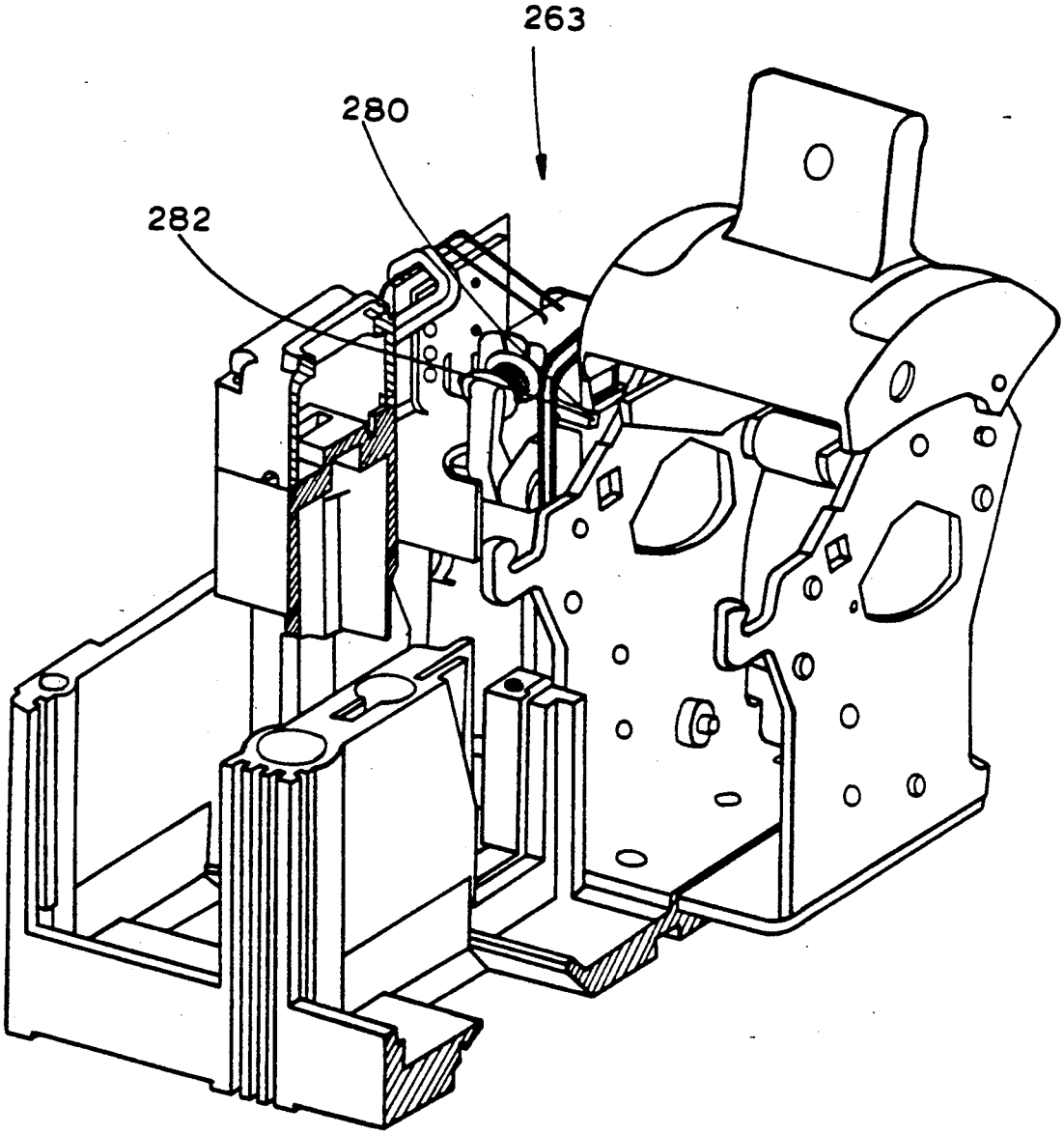
FIG. 28 is a partial perspective view of circuit breaker with an undervoltage release mechanism installed.
Figure 29:
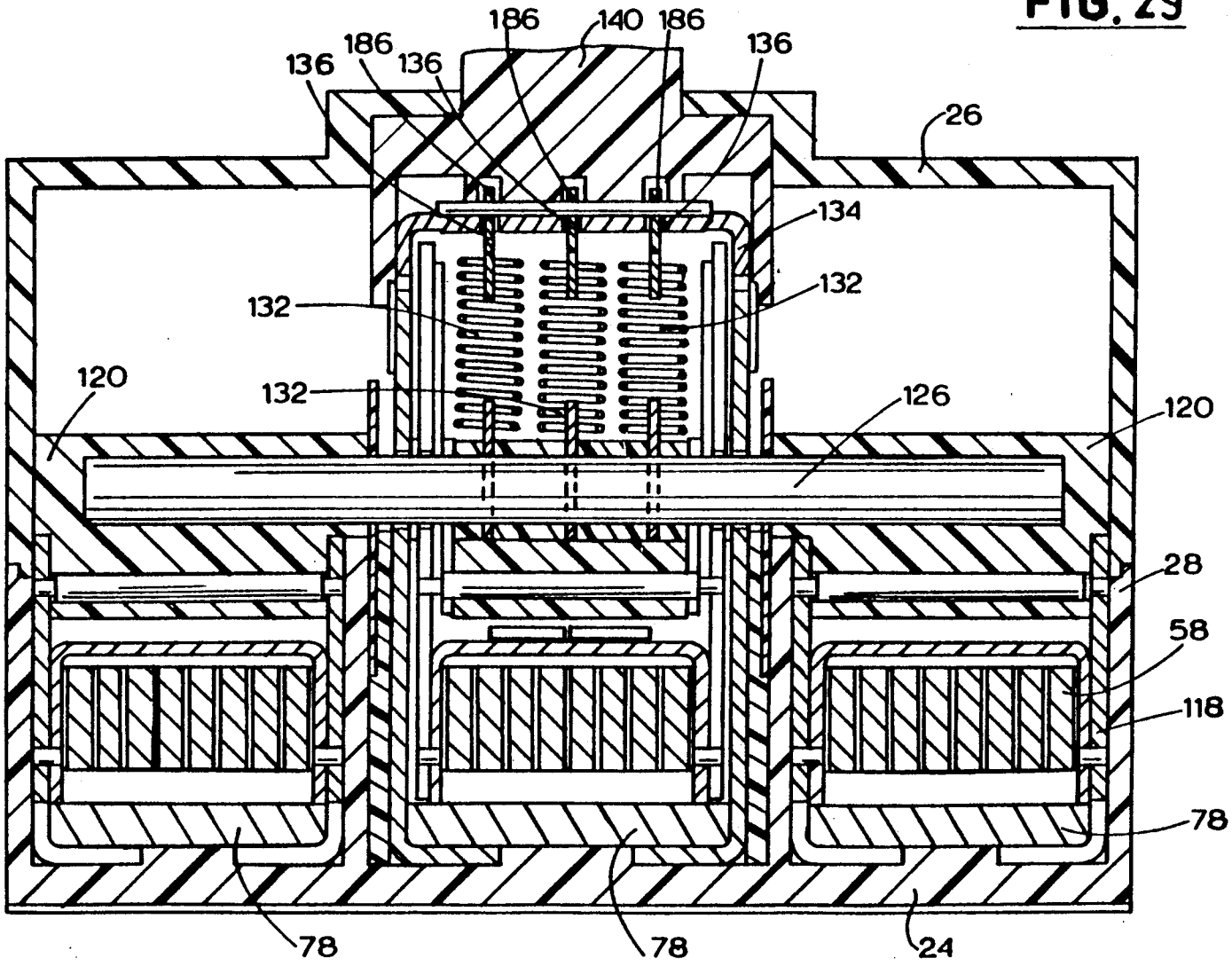
FIG. 29 is an end sectional view along line 29—29 of FIG. 1.

For three phase circuit breakers as shown in FIG. 28, two sidewalls 254 are provided within the base 24. These sidewalls 254 along with the exterior end walls 256 of the housing 22 define three phase compartments 257, 258 and 260 (FIG. 25). The operating mechanism 88 is disposed in the center phase compartment 258. Due to the space limitations within the center phase compartment 258 after the operating mechanism 88 is installed, it is necessary to locate various circuit breaker auxiliaries 262, such as an undervoltage release mechanism 263, an auxiliary contact assembly 265, and the like, in the outer phase compartments 257 and 260. One known auxiliary, an auxiliary switch, is disclosed in U.S. Pat. No. 4,928,079, assigned to the same assignee as the present invention and hereby incorporated by reference.

Since certain auxiliaries 262, such as an undervoltage release mechanism 263 need to be interlocked, for example, with components in the center phase compartment 258; for example, the circuit breaker operating handle 140 or the operating mechanism 88, it is necessary to provide an opening in one side of the sidewalls 254. However, since such auxiliaries 262 are not provided on all circuit breakers 20, separate molded bases have heretofore been provided. More specifically, for circuit breakers 20 provided without auxiliaries 262, a separate molded base has heretofore been provided with solid sidewalls. For those applications where circuit breaker auxiliaries, such as an undervoltage release mechanism, are to be provided, a different molded base with an opening in one of the sidewalls has been provided to allow communication between the auxiliary located in the outer phase compartment and the center compartment 258. The use of separate base units for circuit breakers depending on whether or not auxiliaries are to be provided with the circuit breaker results in increased cost of the circuit breaker. The reversible phase barrier 252 in accordance with the present invention solves this problem and allows a single molded base with an opening 264 in one of the sidewalls 252 to be manufactured. The reversible phase barrier 252 is adapted to be disposed in the opening 264 to enable the molded base to be used for both applications.

Figure 26:
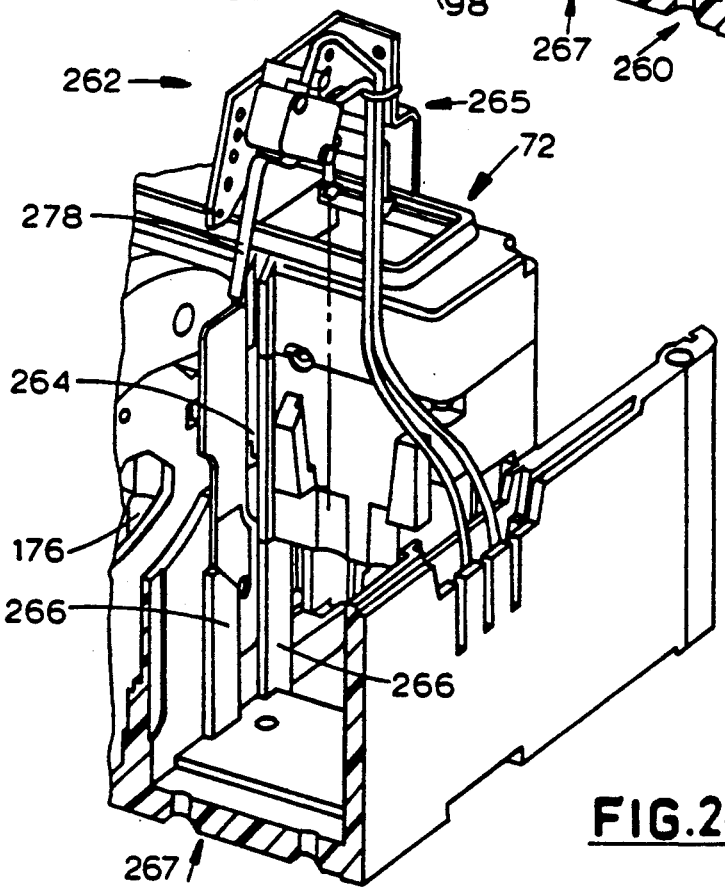
FIG. 26 is similar to FIG. 25 illustrating the reversible phase barrier in a second position.

More specifically, referring to the drawings and in particular FIGS. 25–28, a modified base unit 267 is illustrated which includes a sidewall 254 formed with the opening 264 defined between the electronic trip unit 72 and the cross bar 126 as shown in FIGS. 25 and 26. Disposed below and adjacent the opening 264 on opposing sides are track members 266. The track members 266 allow the reversible phase barrier 252 in accordance with the present invention to be rather easily inserted and removed.

The reversible phase barrier 252 is illustrated in FIG. 27. The reversible phase barrier 252 may be formed in a generally rectangular-shape from an electrically insulating material. One end 268 of the reversible phase barrier 252 is provided with a slot 270. The other end 272 of the reversible phase barrier 252 is solid. The width of the reversible phase barrier 252 is provided to allow quick and easy insertion and removal of the phase member relative to the track members 266.

For circuit breakers 20 provided without auxiliaries 262 as shown in FIG. 25 or with auxiliaries, such as auxiliary contacts 265 shown in FIG. 26, which can be interlocked with the trip link 120 located in an outer phase compartment 257 or 260, the end 268 of the reversible phase barrier 252 is disposed between the track members 266. In this position, the opening 264 formed in the sidewall 252 will be blocked forming an interphase gas barrier.

Such auxiliary contacts 263 are generally provided with a bracket 274, adapted to be received between spaced apart track members 276, integrally formed on the electronic trip unit 72. Once mounted, with an actuator arm 278, formed as part of the auxiliary contact mechanism 263, will be disposed adjacent the trip link 120 located in an outer phase compartment 257 or 260 to allow interlocking therebetween.

For auxiliaries 262, such as undervoltage release mechanisms 263, as illustrated in FIG. 28, the reversible phase barrier 252 may be reversed such that the solid end 272 is disposed between the track members 266 formed in the side wall 252. In this position, the slot end 268 of the barrier 252 will be disposed upwardly such that the slot 270 is aligned with the opening 264 to allow communication between the center phase compartment 258 and the outer phase compartment 257. As shown in FIG. 28, this allows the undervoltage release mechanism 263, normally installed on the load side of an outer phase compartment 257 or 260 to communicate with the center compartment 258. More specifically, the undervoltage release mechanism 263 includes a generally L-shaped actuation arm 280 (FIG. 28) that is normally interlocked with the circuit breaker operating handle 140. By disposing the reversible barrier 252 such that the slot 270 is aligned with the opening 264, an extending portion 282 of the actuator arm 280 is received in the slot 270 to allow communication with the operating handle 140.

Various other circuit breaker auxiliaries 262 are known in the art such as shunt trips and bell alarm contacts. It will be appreciated by those of ordinary skill in the art that the principles of the present invention are adapted to be utilized with all of such auxiliaries. The interlocking between those auxiliaries and the circuit breaker is well within the ordinary skill in the art and thus does not form a part of the present invention.

Obviously, any modifications and variations of the present invention are possible in light of the above teachings. Thus, it is to be understood that, within the scope of the appended claims, the invention may be practiced otherwise than as specifically described above.

What is claimed and desired to be secured by letters patent of the United States is:

1. A molded case circuit breaker comprising:

a molded housing;

one or more pairs of separable main contacts, each pair defining a fixed main contact and a movably mounted main contact, carried by said molded housing;

a contact arm assembly for carrying said movably mounted main contacts;

an operating mechanism, mechanically coupled to said contact arm assembly, for enabling said one or more pairs of separable main contacts to be placed in an ON position or alternatively in an OFF position; and means for uncoupling said operating mechanism from said contact arm assembly during predetermined conditions, said uncoupling means including a plurality of links releasably coupled together between said operating mechanism and said contact arm assembly permitting movement of said contact arm assembly independent of said operating mechanism during said predetermined conditions.

2. A molded case circuit breaker as recited in claim 1, wherein said predetermined conditions include relatively large magnitude overcurrent conditions, such as a short circuit condition.

3. A molded case circuit breaker as recited in claim 1, wherein said plurality of links includes one or more trip links and an insulator link.

4. A molded case circuit breaker as recited in claim 3, further including means for pivotally connecting said one or more trip links to said contact arm assembly.

5. A molded case circuit breaker as recited in claim 3, wherein said operating mechanism includes a crossbar and said insulator link includes means for pivotally connecting said insulator link to said crossbar.

6. A molded case circuit breaker as recited in claim 3, wherein said uncoupling means includes means for releasably coupling said one or more trip links relative to said insulator link.

7. A molded case circuit breaker as recited in claim 6, wherein said releasably coupling means includes one or more detent balls carried by said insulator link.

8. A molded case circuit breaker as recited in claim 6, wherein said one or more trip links are disposed adjacent said insulator link.

9. A molded case circuit breaker as recited in claim 7, further including means for biasing said detent balls relative to said one or more trip links.

10. A molded case circuit breaker comprising:

one or more pairs of separable main contacts, defining a first main contact and a movably mounted main contact, carried by said housing;

a contact arm assembly for carrying said movably mounted main contact;

an operating mechanism, operatively coupled to said contact arm assembly which includes a crossbar and a toggle assembly, said toggle assembly including an upper toggle link and a plurality of lower toggle links mechanically coupled to each other between said upper toggle link and said contact arm assembly; and means for uncoupling said lower toggle links in order to enable said contact arm assembly to be uncoupled from said operating mechanism during relatively large magnitude overcurrent conditions.

11. A molded case circuit breaker as recited in claim 10, wherein said lower toggle links include one or more trip links and one or more insulator links.

12. A molded case circuit breaker as recited in claim 11, wherein said insulator link is formed as an elongated member which includes a generally cylindrical portion with a first axial bore for receiving the crossbar and an irregular-shaped portion which includes a second axial bore for enabling said insulator link to be pivotally connected to said trip links and means for biasing insulator link relative to said one or more trip links.

13. A molded case circuit breaker as recited in claim 12, wherein said irregular portion is provided with a third axial bore.

14. A molded case circuit breaker as recited in claim 13, wherein said biasing means includes one or more detent balls and means for biasing said detent balls relative to said one or more trip links.

15. A molded case circuit breaker as recited in claim 11, wherein said one or more trip links each include a first aperture to enable the trip link to be pivotally connected to said contact arm assembly and a second aperture to enable said trip link to be pivotally connected to said insulator link.

16. A molded case circuit breaker as recited in claim 15, wherein said trip link includes a third aperture which acts as a detent.

17. A molded case circuit breaker as recited in claim 11, wherein said trip link includes an extending arm portion adapted to engage said insulator link during predetermined conditions.

* * * * *